US009454863B2

(12) United States Patent
Chugo

(10) Patent No.: US 9,454,863 B2
(45) Date of Patent: Sep. 27, 2016

(54) BANKNOTE PROCESSING DEVICE AND BANKNOTE PROCESSING METHOD

(71) Applicant: Oki Electric Industry Co., Ltd., Tokyo (JP)

(72) Inventor: Akihiro Chugo, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/414,580

(22) PCT Filed: Jun. 17, 2013

(86) PCT No.: PCT/JP2013/066633

§ 371 (c)(1),
(2) Date: Jan. 13, 2015

(87) PCT Pub. No.: WO2014/024567

PCT Pub. Date: Feb. 13, 2014

(65) Prior Publication Data

US 2015/0170452 A1 Jun. 18, 2015

(30) Foreign Application Priority Data

Aug. 9, 2012 (JP) ..... 2012-177058

(51) Int. Cl.
*G07F 7/04* (2006.01)
*G07D 11/00* (2006.01)

(52) U.S. Cl.
CPC ..... *G07D 11/0018* (2013.01); *G07D 11/0036* (2013.01); *G07D 11/0063* (2013.01); *B65H 2701/1912* (2013.01); *G07D 11/0021* (2013.01); *G07D 11/0084* (2013.01)

(58) Field of Classification Search
CPC ..... B65H 2701/1912; B65H 2301/541; G07D 7/00; G07D 11/0003; G07D 11/0018; G07D 11/0021; G07D 11/0084; G07D 2211/00; G07F 19/205
USPC ..... 194/206, 207, 351; 209/534; 235/379
See application file for complete search history.

(56) References Cited

U.S. PATENT DOCUMENTS 4,883,183 A * 11/1989 Kimura ..... G07D 11/0018 194/206
2004/0134839 A1* 7/2004 Kobayashi ..... G07D 11/0054 209/534

(Continued)

FOREIGN PATENT DOCUMENTS

JP H11-238154 A 8/1999
JP 2001-093022 A 4/2001

(Continued)

OTHER PUBLICATIONS

Decision on Grant issued on Jan. 12, 2016 for corresponding Russian Patent Application and its English translation (14 pages).

(Continued)

*Primary Examiner* — Mark Beauchaine
(74) *Attorney, Agent, or Firm* — Rabin & Berdo P.C.

(57) ABSTRACT

Provided is a banknote processing device capable of efficient pay-in processing for large quantities of banknotes. The banknote processing device includes a pay-in port into which banknotes are inserted, a conveyance section that conveys banknotes from the pay-in port, a pay-in port opening-closing member capable of opening and closing the pay-in port by moving, and a controller that controls the banknote conveyance of the conveyance section and controls opening and closing operation of the pay-in port opening-closing member, wherein the controller pauses count processing and opens the pay-in port opening-closing member in cases in which a count processing stoppage event arises during count processing of banknotes inserted into the pay-in port.

8 Claims, 20 Drawing Sheets

(56) References Cited

U.S. PATENT DOCUMENTS

| | | | | |
|---|---|---|---|---|
| 2008/0142583 | A1* | 6/2008 | Yokoi | G07D 11/0018 235/379 |
| 2013/0015035 | A1* | 1/2013 | Tanaka et al. | 194/206 |

FOREIGN PATENT DOCUMENTS

| | | | |
|---|---|---|---|
| JP | 2001-101476 | A | 4/2001 |
| JP | 2003-248855 | A | 9/2003 |
| JP | 2008-097241 | A | 4/2008 |
| JP | 2009-129316 | A | 6/2009 |
| JP | 2010-231784 | A | 10/2010 |
| RU | 2258959 | C9 | 5/2006 |
| RU | 2353068 | C2 | 4/2009 |

OTHER PUBLICATIONS

Chinese Office Action with translation dated Apr. 29, 2016 (13 pages).

* cited by examiner

BANKNOTE PROCESSING DEVICE AND BANKNOTE PROCESSING METHOD

TECHNICAL FIELD

The present invention relates to a banknote processing device and a banknote processing method.

BACKGROUND ART

Cash processing devices, exemplified by service window cash processing machines, are installed at service counters in branches of financial institutions and the like. Cash processing devices are used in, for example, deposit transactions and withdrawal transactions involving banknotes and coins. A cashier, for example, is able to perform deposit transactions or withdrawal transactions by operating an operation section of the cash processing device, or a reception terminal connected to the cash processing device.

Japanese Patent Application Laid-Open (JP-A) No. 2001-93022 describes a cash processing device that performs pay-in processing to store banknotes inserted into a banknote pay-in port in a stacker after temporarily holding the banknotes in a temporary holding section, and performs pay-out processing to separate banknotes stored in the stacker and convey the banknotes to a banknote pay-out port.

DISCLOSURE OF INVENTION

Technical Problem

Sometimes a large quantity of banknotes are paid in during the pay-in processing described above. There is, however, a limit to the number of banknotes that can be inserted into the banknote pay-in port at once. Further, since the banknote pay-in port is closed by a pay-in port opening-closing member when banknotes are being conveyed in pay-in processing, it is not possible to insert additional banknotes. There is therefore a concern that pay-in processing for large quantities of banknotes can take a long time.

In consideration of the above circumstances, an object of the present invention is to provide a new and improved banknote processing device capable of efficient pay-in processing for large quantities of banknotes.

Solution to Problem

In order to resolve the above issue, one aspect of the present invention provides a banknote processing device including: a pay-in port into which banknotes are inserted; a conveyance section that conveys banknotes from the pay-in port; a pay-in port opening-closing member capable of opening and closing the pay-in port by moving; and a controller that controls the banknote conveyance by the conveyance section and controls opening and closing operation of the pay-in port opening-closing member, wherein the controller, in cases in which a count processing stoppage event arises during count processing of banknotes inserted into the pay-in port, pauses the count processing and opens the pay-in port opening-closing member.

According to this banknote processing device, the controller pauses count processing and opens the pay-in port opening-closing member in cases in which a count processing stoppage event arises during count processing of banknotes inserted into the pay-in port. Since the pay-in port opening-closing member is open, the cashier is able to insert banknotes into the pay-in port while the count processing is paused. This enables additional banknotes to be inserted into the pay-in port before count processing for all of the banknotes previously inserted into the pay-in port has been completed, thereby enabling efficient pay-in processing for large quantities of banknotes.

Further, the above banknote processing device may be configured further including: a pay-out port to which reject banknotes arising during the count processing are conveyed; and a pay-out port opening-closing member capable of opening and closing the pay-out port by moving, wherein the controller opens the pay-in port opening-closing member and the pay-out port opening-closing member in cases in which a stoppage event has occurred during the count processing.

Further, the above banknote processing device may be configured wherein the controller opens the pay-in port opening-closing member and the pay-out port opening-closing member at the same time as each other.

Further, the above banknote processing device may be configured wherein the stoppage event is an event in which the controller receives a request to stop the count processing.

Further, the above banknote processing device may be configured further including: a banknote classification section that classifies the banknotes during the count processing; a pay-out port to which a reject banknote classified by the banknote classification section is conveyed; and a pay-out port opening-closing member capable of opening and closing the pay-out port by moving, wherein the stoppage event is an event in which the reject banknote is conveyed to the pay-out port, and in which the count processing is paused.

Further, the above banknote processing device may be configured further including: a banknote classification section that classifies the banknotes during the count processing; and a first pay-out port and a second pay-out port to which reject banknotes classified by the banknote classification section are conveyed, wherein the controller alternately conveys the reject banknotes to the first pay-out port and the second pay-out port during the count processing.

Further, the above banknote processing device may be configured wherein the controller switches the conveyance destination of the reject banknotes between the first pay-out port and the second pay-out port each time a reject occurrence is detected.

Further, the above banknote processing device may be configured further including: a banknote classification section that classifies the banknotes during the count processing; and a temporary stacking section in which banknotes conveyed from the pay-in port are temporarily stacked, wherein the stoppage event is any event of an event in which the controller receives a count processing stoppage request, an event in which all banknotes have been conveyed from the pay-in port, an event in which reject banknotes classified by the banknote classification section cannot be conveyed, or an event in which a specific number of reject banknotes are stacked in the temporary stacking section.

Moreover, in order to resolve the above issue, another aspect of the present invention provides a banknote processing device including: a pay-in port into which banknotes are inserted; a conveyance section that conveys banknotes from the pay-in port; a storage section to which the banknotes are conveyed and stored; a pay-in port opening-closing member capable of opening and closing the pay-in port by moving; a locking mechanism capable of locking the pay-in port opening-closing member; and a controller that controls the banknote conveyance by the conveyance section, opening and closing operation of the pay-in port opening-closing member, and operation of the locking mechanism, wherein the controller, during conveyance of banknotes from the pay-in port to the storage section, releases a locked state of the pay-in port opening-closing member that is in a closed state.

The above banknote processing device may be configured further including: a temporary stacking section in which banknotes conveyed from the pay-in port during pay-in processing are temporarily stacked, wherein the controller, during conveyance of banknotes stacked in the temporary stacking section to the storage section, releases a locked state of the pay-in port opening-closing member that is in a closed state.

Moreover, in order to resolve the above issue, another aspect of the present invention provides a banknote processing method for controlling conveyance of banknotes inserted into a pay-in port, and controlling opening and closing operation of a pay-in port opening-closing member capable of opening and closing the pay-in port, the banknote processing method including: conveying banknotes from the pay-in port and executing count processing; and pausing the count processing and opening the pay-in port opening-closing member in cases in which a count processing stoppage event arises during the count processing.

Advantageous Effects of Invention

According to the present invention described above, a large quantity of banknotes can be paid in efficiently.

BEST MODE FOR CARRYING OUT THE INVENTION

Figure 1:
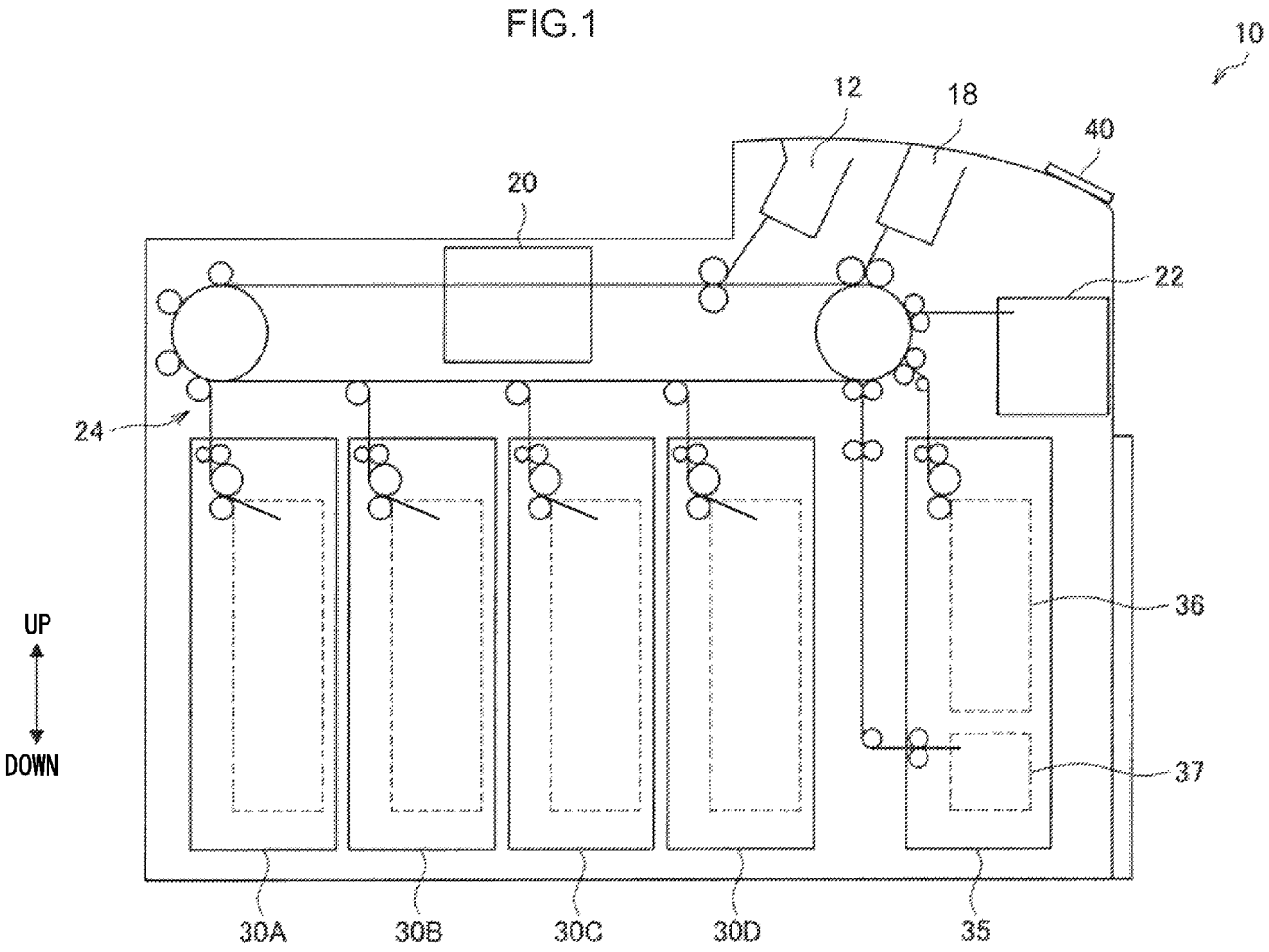
FIG. 1 is a drawing illustrating an example of an internal configuration of a banknote processing device 10 according to a first exemplary embodiment.

Detailed explanation follows regarding preferable exemplary embodiments of the present invention, with reference to the attached drawings. Note that in the present specification and in the drawings, configuration elements with substantially the same functional configuration are allocated the same reference numerals, and redundant explanation thereof is omitted.

1. First Exemplary Embodiment

1-1. Example of Banknote Processing Device Internal Configuration

Explanation follows regarding an example of an internal configuration of a banknote processing device 10 according to a first exemplary embodiment, with reference to FIG. 1.

FIG. 1 illustrates an example of an internal configuration of the banknote processing device 10 according to the first exemplary embodiment. The banknote processing device 10 is installed in a branch of a financial institution or the like. The banknote processing device 10 is a cashier-operated terminal that performs banknote transactions based on operation by a device operator, namely a member of staff such as a service counter cashier at the financial institution.

As illustrated in FIG. 1, the banknote processing device 10 includes a pay-in port 12, a pay-out port 18, a banknote identification section 20 serving as an example of a banknote classification section, a temporary holding section 22 serving an example of a temporary stacking section, a conveyance section 24, banknote cassettes 30A to 30D serving as an example of a storage section, a reject-box installed banknote cassette 35, and a display section 40.

The pay-in port 12 is an insertion port through which the cashier inserts banknotes. The pay-in port 12 has a separating function of separating and feeding out notes, inserted in a bundle, one note at a time. The pay-in port 12 is provided with a pay-in port shutter 13 that opens and closes an opening portion, as illustrated in FIG. 2A and FIG. 2B.

The pay-out port 18 is a dispensing port that dispenses (pays out) banknotes, which are then taken by the cashier. The pay-out port 18 has a stacking function of stacking the banknotes to be dispensed. The pay-out port 18 includes, for example, sufficient capacity to stack 100 banknotes (maximum stacking number). Note that as illustrated in FIG. 2A and FIG. 2B, the pay-out port 18 is provided with a pay-out port shutter 19 that opens and closes an opening portion of the pay-out port 18.

Figure 2A:
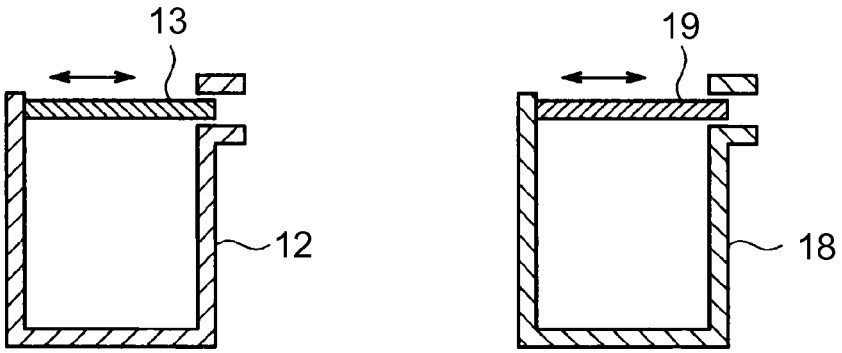
FIGS. 2A and 2B are schematic drawings illustrating an example of configuration of a pay-in port shutter 13 and a pay-out port shutter 19.
Figure 2B:
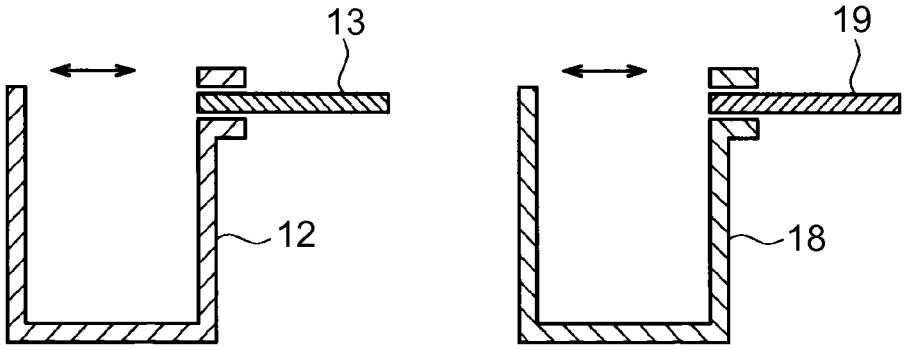

FIG. 2A and FIG. 2B are schematic diagrams illustrating an example of configuration of the pay-in port shutter 13 and the pay-out port shutter 19. FIG. 2A illustrates closed states of the pay-in port shutter 13 and the pay-out port shutter 19, and FIG. 2B illustrates open states of the pay-in port shutter 13 and the pay-out port shutter 19. The pay-in port shutter 13 and the pay-out port shutter 19 close the pay-in port 12 and the pay-out port 18 by moving. Note that the pay-in port shutter 13 is closed during conveyance of banknotes from the pay-in port 12, and the pay-out port shutter 19 is closed during conveyance of banknotes to the pay-out port 18. In FIG. 2A and FIG. 2B, the flat plane shaped pay-in port shutter 13 and pay-out port shutter 19 are opened and closed by sliding, however curved plane shaped shutters may be opened and closed by turning.

The banknote identification section 20 classifies passing banknotes one note at a time. The banknote identification section 20 accommodates banknotes travelling in both directions, such that the banknote identification section 20 can classify banknotes being conveyed from the pay-in port 12 side, and also banknotes being conveyed in the opposite direction. Specifically, the banknote identification section 20 classifies a conveyed banknote passing along a conveyance path by denomination, authenticity (genuine note/counterfeit note), physical condition (good condition note/damaged note), traveling state (normal/abnormal), and the like, conferring a normal determination or a reject determination on the passing banknote.

In the present specification, a genuine note refers to a note that has been classified as a banknote, and a counterfeit note refers to one that has not been classified as a banknote. Out of banknotes classified as genuine notes, a good condition note means one that has been classified as suitable for pay-in/pay-out. Out of banknotes classified as genuine notes, a damaged note means one that has been classified as unsuitable for pay-in/pay-out. Reject determination is made based on factors such as authenticity, physical condition (for example dirt, damage, abnormal external profile), and traveling abnormalities (for example skewed banknotes, overlapping travel). Reject banknotes may also include banknotes that are not used in pay-out (such as 2000 yen notes or 5000 yen notes), or foreign currency banknotes.

The temporary holding section 22 has both a banknote separating and a banknote stacking function. In a pay-in transaction, for example, the temporary holding section 22 temporarily stacks banknotes that have been separated out from the pay-in port 12 and classified as normal by the banknote identification section 20. Banknotes stacked in the temporary holding section 22 are fed out on successful completion of a transaction, for example when the paid-in banknotes have been confirmed in an account, and are conveyed through the banknote identification section 20 to the banknote cassettes 30A to 30D, for example. Note that the temporary holding section 22 may be a stacking type that sequentially stacks banknotes one on top of the other, or may be a drum type that stores banknotes by sequential winding.

The conveyance section 24 includes conveyance paths, conveyance rollers that convey banknotes, and a drive mechanism for driving the respective conveyance rollers, and conveys banknotes one note at a time. The drive mechanism drives the conveyance rollers by rotation of a DC servomotor, pulse motor, or the like. The conveyance section 24 is controlled by a controller, described later, to convey banknotes to their conveyance destinations.

The banknote cassettes 30A to 30D are banknote storage sections capable of storing banknotes by denomination, and include both a banknote stacking function and separating function. The banknote cassettes 30A to 30D may include plural banknote cassettes for a single denomination. For example, the banknote cassettes 30A and 30C may be banknote cassettes for 10,000 yen notes, and the banknote cassettes 30B and 30D may be banknote cassettes for 1000 yen notes. The respective banknote cassettes 30A to 30D may be configured with a structure detachable from the banknote processing device 10, enabling individual exchange of the banknote cassettes 30A to 30D to load banknotes into the banknote cassettes 30A to 30D.

The reject box-installed banknote cassette 35 (also referred to below as the banknote cassette 35) has a structure detachable from the banknote processing device 10, enabling banknotes to be retrieved and replenished by individually exchanging the banknote cassette 35. Further, the banknote cassette 35 is equipped with a banknote storage box 36 at the upper side, and a reject box 37 at the lower side (bottom portion).

The banknote storage box 36 has a stacking function for stacking banknotes and a separating function for feeding banknotes out one note at a time. The banknote storage box 36 is capable of stacking banknotes that have been separated from each of the banknote cassettes 30A to 30D during cassette counted retrieval, and retrieving banknotes. In cassette counted replenishment, the banknote storage box 36 feeds out banknotes that have been stacked in the banknote storage box 36, enabling replenishment of banknotes in the banknote cassettes 30A to 30D.

The reject box 37 has only a stacking function for stacking banknotes. The reject box 37 is a banknote storage section for stacking banknotes (reject banknotes) that the banknote identification section 20 has classified as abnormal (reject determination).

The display section 40 displays a menu screen and a processing result screen. The display section 40 is, for example, implemented by a Cathode Ray Tube (CRT) display device, a Liquid Crystal Display (LCD) device, or an Organic Light Emitting Diode (OLED) device.

The banknote processing device 10 includes an operation section (not illustrated in the drawings) that can be operated by the cashier. The banknote processing device 10 performs pay-in processing and pay-out processing corresponding to pay-in transactions and pay-out transactions based on operation of the operation section by the cashier. Note that the banknote processing device 10 may also perform processing based on cashier operation of a reception terminal connected to the banknote processing device 10, rather than the operation section.

1-2. Banknote Processing Device Basic Processing

As basic processing, the banknote processing device 10 performs, for example, pay-in processing, pay-out processing, replenishment processing, and retrieval processing. In the following explanation, each type of processing is explained with reference to FIG. 1.

Pay-in Processing

Pay-in processing is processing to stack notes from the pay-in port 12 inside the banknote processing device 10. As pay-in processing, the banknote processing device 10 performs, for example, normal pay-in processing in which paid-in banknotes are held back in the temporary holding section 22 and then stacked in the banknote cassettes 30A to 30D from the temporary holding section 22, and direct pay-in processing in which the paid-in banknotes are stacked directly in the banknote cassettes 30A to 30D without being held back in the temporary holding section 22. Note that the banknote processing device 10 can be set so as to select normal pay-in processing or direct pay-in processing.

First, explanation is given regarding normal pay-in processing. In normal pay-in processing, banknotes inserted into the pay-in port 12 are first separated and fed out one note at a time, and the fed-out banknotes are conveyed to the banknote identification section 20 by the conveyance section 24. Next, the banknote identification section 20 performs banknote classification, and banknotes given a classification result of normal are conveyed to and stacked in the temporary holding section 22. Then, once the pay-in amount has been confirmed, processing transitions to stacking processing.

However, any banknotes given a classification result of abnormal by the banknote identification section 20 (reject banknotes) are stacked in the pay-out port 18. The cashier may reinsert banknotes stacked in the pay-out port 18 into the pay-in port 12 for reclassification by the banknote identification section 20. Note that in the following explanation, processing in which the banknote identification section 20 classifies banknotes, and the banknotes are conveyed to a conveyance destination based on the classification results, is also referred to as count processing.

In stacking processing, banknotes are first separated from the temporary holding section 22 one note at a time, and the separated banknotes are conveyed to the banknote identification section 20. Banknotes given a classification result of normal by the banknote identification section 20 are stacked in the banknote cassette 30A to 30D for the corresponding denomination. On the other hand, any banknotes given a classification result of abnormal by the banknote identification section 20, such as dirty notes, folded banknotes, or banknotes travelling abnormally such as skewed banknotes, are stacked in the reject box 37 of the banknote cassette 35.

On the other hand, transition is made to return processing when pay-in banknote return (cancellation) is instructed prior to confirmation of a pay-in amount. In return processing, banknotes are first separated from the temporary holding section 22 one note at a time, and the separated banknotes are conveyed to the banknote identification section 20. All of the banknotes are then stacked in the pay-out port 18, regardless of whether the banknote identification section 20 gives a classification result of normal or abnormal.

Next, explanation follows regarding direct pay-in processing. Banknotes inserted into the pay-in port 12 are classified by the banknote identification section 20, similarly to in normal pay-in processing. Banknotes given a classification result of normal are stacked in the banknote cassette 30A to 30D for the corresponding denomination. On the other hand, banknotes given a classification result of abnormal (reject banknotes) are stacked in the pay-out port 18. The cashier may reinsert any banknotes stacked in the pay-out port 18 into the pay-in port 12 for reclassification by the banknote identification section 20.

Pay-out Processing

Pay-out processing is processing in which banknotes in the banknote cassettes 30A to 30D are stacked in the pay-out port 18.

In pay-out processing, banknotes corresponding to a specified amount are first separated and fed out from the banknote cassettes 30A to 30D, one note at a time, and the fed-out banknotes are conveyed to the banknote identification section 20 by the conveyance section 24. The banknote identification section 20 then performs banknote classification, and banknotes given a classification result of normal are stacked in the pay-out port 18. Specifically, banknotes are stacked (accumulated) in the pay-out port 18 according to, for example, the denomination and number of normal banknotes for pay-out. On the other hand, banknotes given a classification result of abnormal, namely banknotes that cannot be paid to a customer, are stacked in the reject box 37 of the banknote cassette 35.

Replenishment Processing

Replenishment processing is processing to replenish banknotes in the banknote processing device 10. In the banknote processing device 10, specific possible replenishment methods include pay-in port replenishment, cassette exchange replenishment, and cassette counted replenishment. Explanation follows regarding each replenishment method.

Pay-in port replenishment is similar in operation to the pay-in processing described above. For example, banknotes fed out from the pay-in port 12 and given a classification result of normal by the banknote identification section 20 are held back in the temporary holding section 22, and then stacked in the banknote cassette 30A to 30D of the corresponding denomination. On the other hand, banknotes given a classification result of abnormal are stacked in the pay-out port 18.

Cassette exchange replenishment makes use of the detachability of the banknote cassettes 30A to 30D. Banknotes are replenished by exchanging any of the already-mounted banknote cassettes 30A to 30D for a banknote cassette that has been preloaded with banknotes. Note that in cassette exchange replenishment, an operator must manually record the denomination and number of replenished banknotes.

In cassette counted replenishment, first, the banknote storage box 36 of the banknote cassette 35 is preloaded with banknotes and set in the banknote processing device 10. Banknotes are then fed out from the banknote storage box 36 one note at a time, and banknotes given a classification result of normal by the banknote identification section 20 are stacked in the banknote cassette 30A to 30D for the corresponding denomination. On the other hand, banknotes given a classification result of abnormal are stacked in the reject box 37. Since count processing is executed by the banknote identification section 20 in cassette counted replenishment, there is no need for an operator to manually record the denomination and number of replenished banknotes.

Retrieval Processing

Retrieval processing is processing to retrieve banknotes from inside the banknote processing device 10. In the banknote processing device 10, specific possible retrieval methods are pay-out port retrieval, cassette exchange retrieval, and cassette counted retrieval. Explanation follows regarding each retrieval method.

Pay-out port retrieval is similar in operation to the pay-out processing described above. For example, banknotes fed out from the retrieval target banknote cassette 30A to 30D and given a classification result of normal by the banknote identification section 20 are stacked in the pay-out port 18. On the other hand, banknotes given a classification result of abnormal are stacked in the reject box 37. When this has been performed for all of the banknotes stacked in the retrieval target banknote cassette 30A to 30D, the cashier can retrieve all the banknotes determined to be normal from the pay-out port 18. The cashier can also retrieve banknotes determined to be abnormal from the reject box 37.

In cassette exchange retrieval, banknotes are retrieved by removing a specific cassette out of the banknote cassettes 30A to 30D from the banknote processing device 10. Note that in cassette exchange retrieval, an operator has to take the banknotes out from the removed banknote cassette 30A to 30D and manually count the denomination and number of the retrieved banknotes.

In cassette counted retrieval, banknotes fed out from the retrieval target banknote cassette out of the banknote cassettes 30A to 30D and given a classification result of normal by the banknote identification section 20 are stacked in the banknote storage box 36 of the banknote cassette 35. On the other hand, banknotes given a classification result of abnormal are stacked in the reject box 37. Then, the cashier can retrieve the banknotes determined to be normal and the banknotes determined to be abnormal by removing only the banknote cassette 35 from the banknote processing device 10. In cassette counted retrieval, count processing is executed by the banknote identification section 20, and so there is no need for an operator to manually count the denomination and number of retrieved banknotes.

1-3. Issues Arising When Paying-out Banknotes in Large Quantities

Explanation follows regarding an issue that arises when paying out a large quantity of banknotes, using a Comparative Example.

In a banknote processing device according to the Comparative Example, a pay-in port shutter is closed during pay-in processing of banknotes inserted into a pay-in port, and insertion of additional banknotes into the pay-in port is not possible. Moreover, although reject banknotes are stacked in a pay-out port, the reject banknotes cannot be removed during pay-in processing. Namely, the insertion of additional banknotes and removal of reject banknotes is not possible until count processing (included in the pay-in processing) of the banknotes inserted into the pay-in port has completed. It accordingly takes a long time to pay in large quantities of banknotes.

Moreover, in the banknote processing device according to the Comparative Example, the following issue can occur when reinserting reject banknotes into the pay-in port. Specifically, when reject banknotes are stacked in the pay-out port after completion of count processing, a pay-in port shutter opens only after a pay-out port shutter has opened and the cashier has removed the reject banknotes from the pay-out port. The cashier therefore has to wait for the pay-in port shutter to open when reinserting reject banknotes removed from the pay-out port into the pay-in port.

In contrast thereto, as will be described in detail later, the banknote processing device 10 according to the first exemplary embodiment pauses count processing and opens the pay-in port shutter 13 in cases in which a count processing stoppage event arises during count processing of the banknotes inserted into the pay-in port 12. This accordingly allows the cashier to insert banknotes into the pay-in port 12 while the count processing is stopped. In other words, the cashier is able to insert additional banknotes into the pay-in port 12 before count processing for all of the banknotes inserted into the pay-in port 12 has been completed, thus enabling efficient pay-in processing of large quantities of banknotes.

Moreover in the first exemplary embodiment, the pay-in port shutter 13 and the pay-out port shutter 19 are both opened in cases in which a stoppage event arises during count processing. This allows the cashier to remove any reject banknotes stacked in the pay-out port 18 while the count processing is stopped. Efficient pay-in processing is made possible as a result, since reject banknotes can be reinserted into the pay-in port 12 while the count processing is stopped.

1-4. Banknote Processing Device Functional Configuration Example

Figure 3:
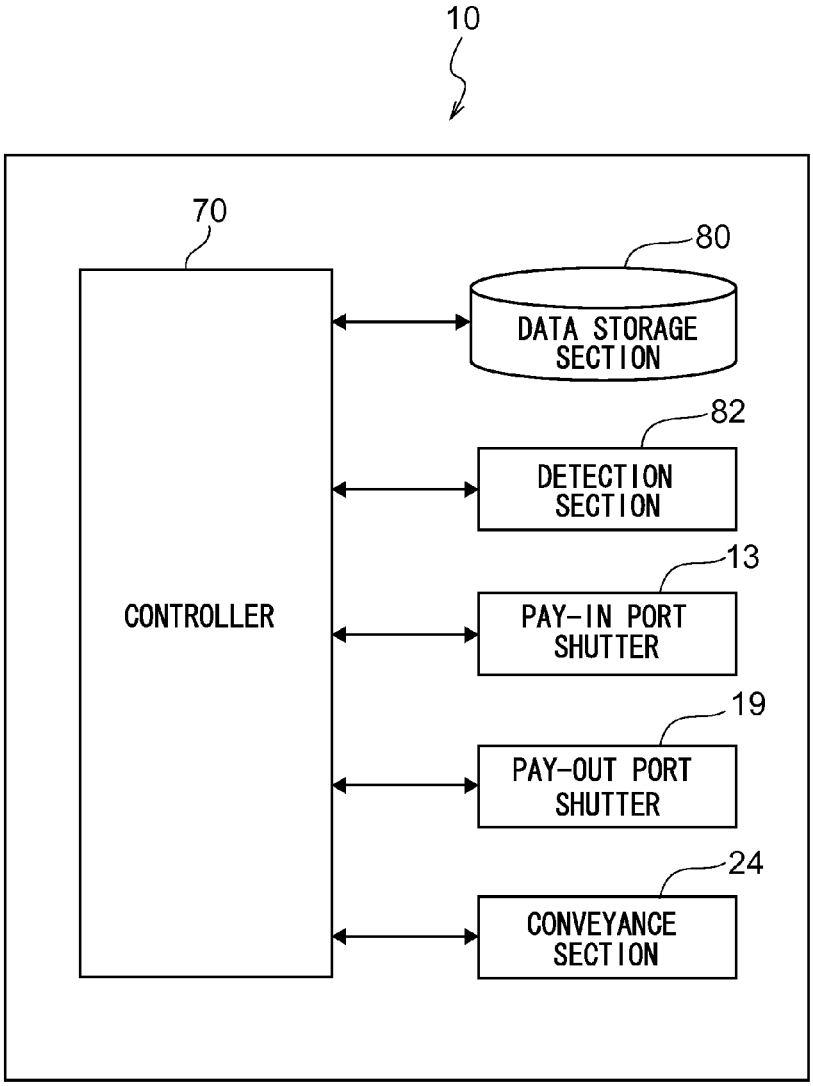
FIG. 3 is a block diagram illustrating an example of a functional configuration of the banknote processing device 10.

Explanation follows regarding an example of a functional configuration of the banknote processing device 10, with reference to FIG. 3. FIG. 3 is a block diagram illustrating an example of the functional configuration of the banknote processing device 10. As illustrated in FIG. 3, the banknote processing device 10 includes a controller 70, a data storage section 80, and a detection section 82.

The controller 70 controls overall operation of the banknote processing device 10. Specifically, the controller 70 controls basic processing such as the pay-in processing, pay-out processing, replenishment processing, and retrieval processing described above. For example, the controller 70 controls conveyance of the banknotes by the conveyance section 24, and opening and closing operations of the pay-in port shutter 13 and the pay-out port shutter 19.

Note that in the first exemplary embodiment, the controller 70 controls the pay-in port shutter 13 and the pay-out port shutter 19 as follows when performing pay-out processing for a large quantity of banknotes.

The controller 70 pauses count processing and opens the pay-in port shutter 13 in cases in which a count processing stoppage event arises during count processing of the banknotes inserted into the pay-in port 12. This enables the cashier to insert additional banknotes into the pay-in port 12 before count processing of all the banknotes inserted into the pay-in port 12 has been completed, thereby enabling efficient pay-in processing of large quantities of banknotes.

A stoppage event in count processing refers to an event in which the controller receives a request to stop the count processing. In such cases, the cashier is able to deliberately stop the count processing and insert additional banknotes into the pay-in port 12.

Note that stoppage events in count processing are not limited to the above scenario. For example, count processing stoppage events may be any event including: an event in which the controller 70 receives a request to stop count processing; an event in which all of the banknotes have been conveyed from the pay-in port 12; an event in which a reject banknote classified by the banknote identification section 20 cannot be conveyed; or an event in which a specific number of reject banknotes have been stacked in the temporary holding section 22. Additional banknotes can accordingly be inserted into the pay-in port 12 when the count processing has stopped due to a variety of causes.

The controller 70 may open both the pay-in port shutter 13 and the pay-out port shutter 19 in cases in which a stoppage event arises during count processing. This enables the cashier to remove the reject banknotes while the count processing is stopped. The cashier can reinsert the removed reject banknotes into the pay-in port 12, thereby enabling efficient pay-in processing of large quantities of banknotes.

The controller 70 may open the pay-in port shutter 13 and the pay-out port shutter 19 at the same time as each other. This enables quick reinsertion of reject banknotes stacked in the pay-out port 18 into the pay-in port 12. Note that the controller 70 may open the pay-in port shutter 13 after opening the pay-out port shutter 19.

The data storage section 80 is stored with a program for operating the banknote processing device 10 and the like. The data storage section 80 may also be stored with classification results of the banknote identification section 20.

The detection section 82 includes optical sensors and the like, and detects various states. For example, the detection section 82 detects a stacking state (number of stacked banknotes, whether or not banknotes have been removed) of banknotes in the pay-in port 12 or the pay-out port 18. The detection section 82 may also detect a banknote conveyance state.

Note that the functions of the controller 70 and the data storage section 80 described above may be implemented by a hardware configuration including a Central Processing Unit (CPU), Read Only Memory (ROM), Random Access Memory (RAM) and the like. The CPU includes a computing function and a control function, and controls overall operation of the banknote processing device 10 using various programs. The ROM stores programs, computation parameters, and the like employed by the CPU. The RAM temporarily stores programs executed by the CPU, appropriately modified parameters employed in such execution, and the like.

1-5. Pay-in Processing Example

Explanation follows regarding an example of pay-in processing according to the first exemplary embodiment, with reference to FIG. 4 to FIG. 7. FIG. 4 to FIG. 7 are flow charts illustrating an example of pay-in processing according to the first exemplary embodiment. The pay-in processing described below is normal pay-in processing, in which pay-in banknotes are first held back in the temporary holding section 22 before being stacked in the banknote cassettes 30A to 30D from the temporary holding section 22.

Figure 4:
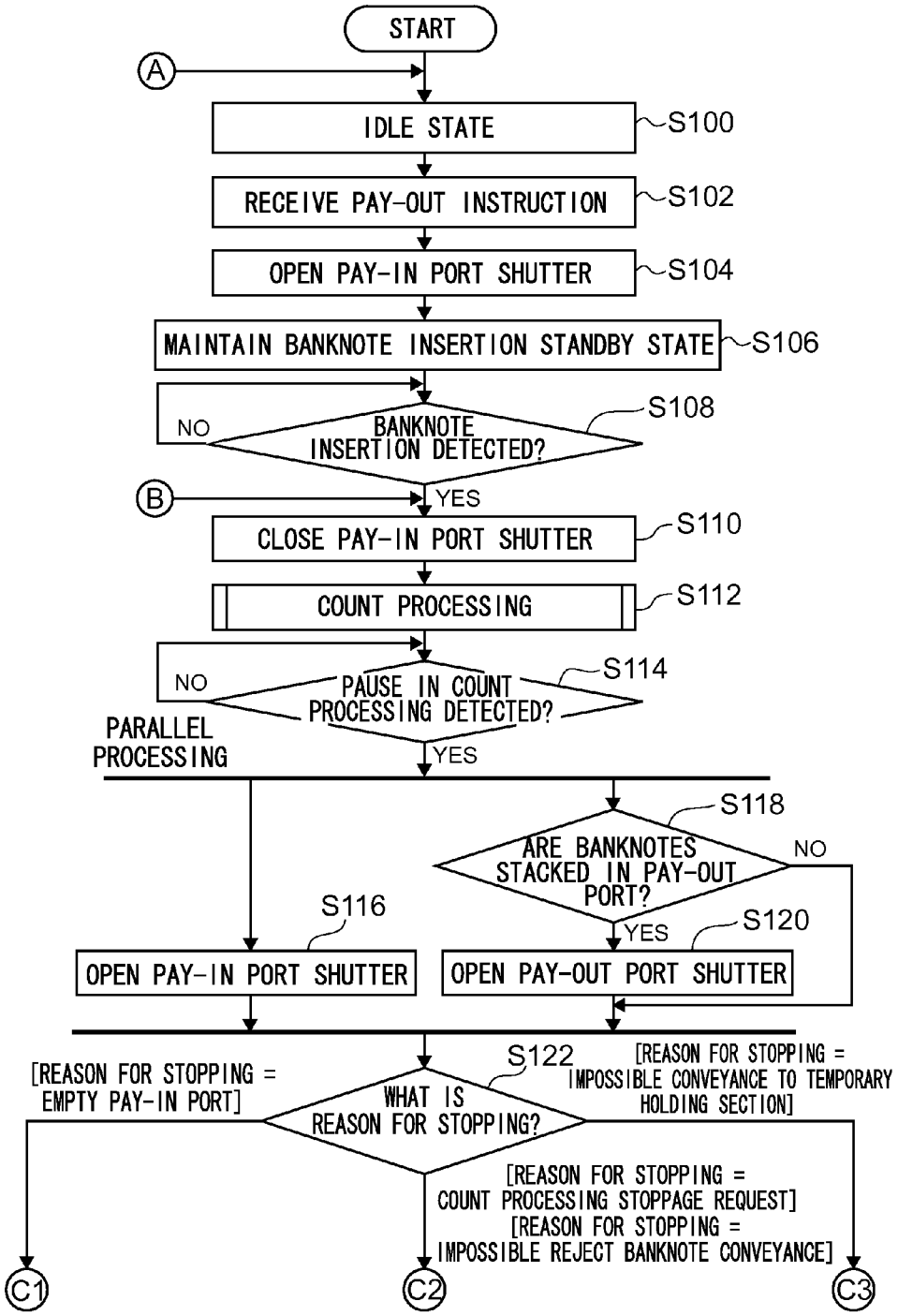
FIG. 4 is a flow chart illustrating an example of pay-in processing according to the first exemplary embodiment.

The flow chart in FIG. 4 is, for example, implemented by the CPU of the controller 70 executing a program stored in the ROM. Note that the executed program may be stored on a storage medium such as a Compact Disk (CD), a Digital Versatile Disk (DVD), or a memory card, or may be downloaded from a server or the like via the internet.

The flow chart in FIG. 4 starts in a pay-in processing idle state, namely a state in which the pay-in port shutter 13 and the pay-out port shutter 19 are both closed (step S100). When the cashier operates an operation section of the banknote processing device 10, or a reception terminal connected to the banknote processing device 10, to select a pay-in transaction, the controller 70 receives the selected pay-in transaction instruction (step S102).

Next, the controller 70 opens the pay-in port shutter 13 to allow the cashier to insert banknotes into the pay-in port 12 (step S104). The controller 70 then maintains a banknote insertion standby state in which the pay-in port shutter 13 is open and the pay-out port shutter 19 is closed (step S106). In the banknote insertion standby state, the cashier is able to insert banknotes into the pay-in port 12.

Then, when insertion of banknotes to the pay-in port 12 has been detected (step S108: Yes), the controller 70 closes the pay-in port shutter 13 (step S110). The controller 70 then performs count processing on the inserted banknotes (step S112). Namely, the controller 70 uses the banknote identification section 20 to classify banknotes fed out from the pay-in port 12, and conveys the banknotes to a conveyance destination based on the classification results.

Note that in the banknote processing device 10, the cashier is able to pause count processing that is in progress, and is also able to restart the count processing after pausing. Specifically, the cashier pauses or restarts count processing by operating the operation section of the banknote processing device 10, or the reception terminal connected to the banknote processing device 10 (for example, by pressing a button). Note that pausing of the count processing is not limited to when the cashier makes a count processing stoppage request. For example, cases in which all of the banknotes inserted into the pay-in port 12 have been conveyed (empty pay-in port), cases in which reject banknotes cannot be conveyed (impossible reject banknote conveyance), and cases in which banknotes cannot be conveyed to the temporary holding section 22 (impossible conveyance to temporary holding section) are also reasons for pausing count processing.

When the controller 70 detects that count processing has been paused for any of the above reasons (step S114: Yes), the controller 70 processes operation of the pay-in port shutter 13 and the pay-out port shutter 19 in parallel. Namely, the controller 70 opens the pay-in port shutter 13 (step S116). The controller 70 also determines whether or not any reject banknotes are stacked in the pay-out port 18 (step S118), and opens the pay-out port shutter 19 (step S120) if reject banknotes are indeed stacked in the pay-out port 18 at step S118 (Yes). In such cases, the controller 70 opens the pay-in port shutter 13 and the pay-out port shutter 19 at the same time as each other.

On the other hand, if no reject banknotes are stacked in the pay-out port 18 at step S118 (No), the controller 70 does not open the pay-out port shutter 19. Note that in the above explanation, the pay-in port shutter 13 and the pay-out port shutter 19 are opened at the same time as each other, however the present exemplary embodiment is not limited thereto, and the controller 70 may open one out of the pay-in port shutter 13 and the pay-out port shutter 19 before the other.

Opening both the pay-in port shutter 13 and the pay-out port shutter 19 enables, for example, the cashier to reinsert the reject banknotes stacked in the pay-out port 18 into the pay-in port 12. Reclassification of reject banknotes can accordingly be performed quickly.

Next, the controller 70 determines the reason for pausing count processing (step S122). Namely, the controller 70 determines whether the reason for stopping is a count processing stoppage request, empty pay-in port, impossible reject banknote conveyance, or impossible conveyance to temporary holding section. The controller 70 then performs processing according to the reason for stopping, as described below.

Reason for Stopping: Empty Pay-in Port

Figure 5:
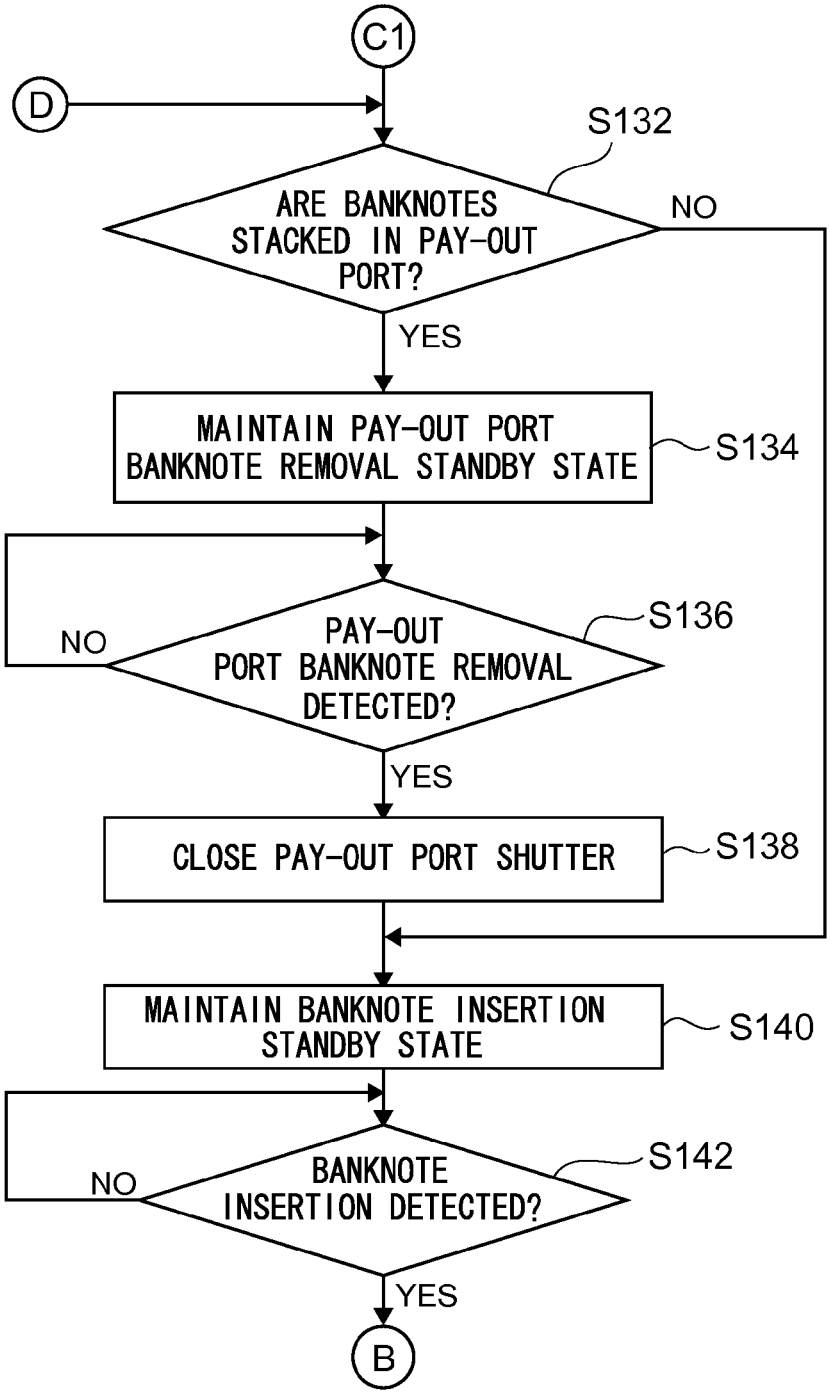
FIG. 5 is a flow chart illustrating an example of pay-in processing according to the first exemplary embodiment.

Explanation follows with reference to the flow chart in FIG. 5 regarding processing when the reason for stopping count processing at step S122 is an empty pay-in port.

In the flow chart in FIG. 5, the controller 70 first determines whether or not any reject banknotes are stacked in the pay-out port 18 (step S132). If reject banknotes are stacked in the pay-out port 18 at step S132 (Yes), the controller 70 maintains a reject banknote removal standby state in which the pay-in port shutter 13 and the pay-out port shutter 19 are both open (step S134). The cashier removes the reject banknotes from the pay-out port 18 in the reject banknote removal standby state. The cashier can also insert additional banknotes into the pay-in port 12 in the reject banknote removal standby state.

Then, when the controller 70 detects that the reject banknotes have been removed from the pay-out port 18 (step S136), the controller 70 closes the pay-out port shutter 19 (step S138). The controller 70 then maintains the banknote insertion standby state in which only the pay-in port shutter 13 is open (step S140). In the banknote insertion standby state, the cashier is able to insert additional banknotes (for example the reject banknotes removed from the pay-out port 18) into the pay-in port 12. Note that, even if there are no reject banknotes stacked in the pay-out port 18 at step S132 (No), the controller 70 maintains the banknote insertion standby state (step S140).

Then, when the controller 70 detects that banknotes have been inserted into the pay-in port 12 (step S142: Yes), processing returns to the flow chart illustrated in FIG. 4 and the pay-in port shutter 13 is closed (step S110). The controller 70 then repeats the count processing (step S112).

Reason for Stopping: Count Processing Stoppage Request, or Impossible Reject Banknote Conveyance Explanation follows with reference to the flow chart in FIG. 6 regarding processing when the reason for stopping at step S122 in the count processing is a count processing stoppage request or impossible reject banknote conveyance.

Figure 6:
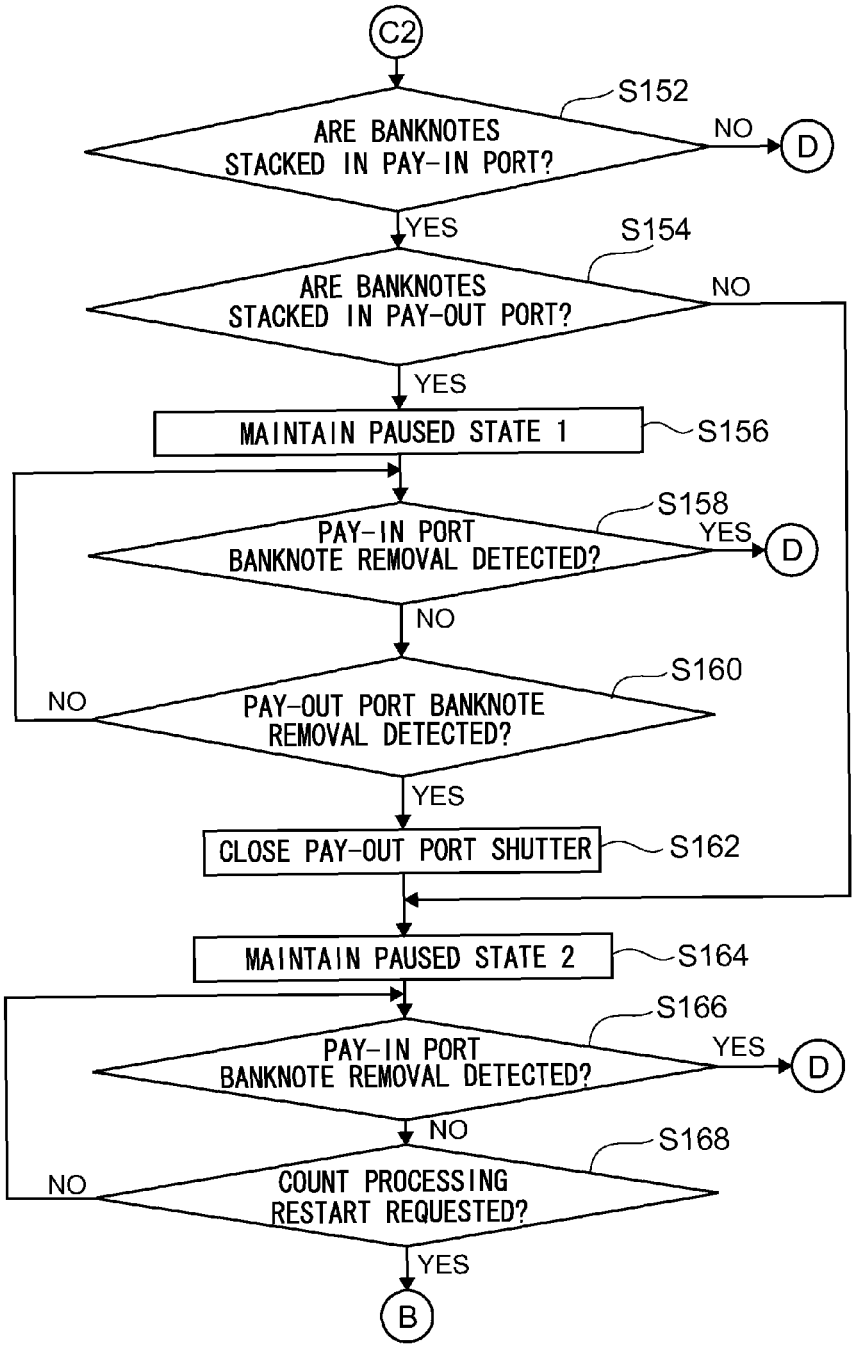
FIG. 6 is a flow chart illustrating an example of pay-in processing according to the first exemplary embodiment.

In the flow chart in FIG. 6, the controller 70 determines whether or not banknotes are stacked in the pay-in port 12 (step S152). If banknotes are not stacked in the pay-in port 12 at step S152 (No), the controller 70 performs the processing described above at step S132 in FIG. 5. Namely, the controller 70 performs the same processing as when the reason for stopping is an empty pay-in port.

However, if banknotes are stacked in the pay-in port 12 at step S152 (Yes), the controller 70 determines whether or not any reject banknotes are stacked in the pay-out port 18 (step S154). When there are reject banknotes stacked in the pay-out port 18 at step S154 (Yes), the controller 70 maintains a paused state 1 in which the pay-in port shutter 13 and the pay-out port shutter 19 are both open (step S156). In the paused state 1, the cashier may insert additional banknotes into the pay-in port 12. The cashier is also able to remove the banknotes stacked in the pay-in port 12, and/or the reject banknotes stacked in the pay-out port 18.

When removal of the banknotes from the pay-in port 12 is detected in the paused state 1 (step S158: Yes), the controller 70 returns to the processing of step S132 in FIG. 5, and performs the same processing as when the reason for stopping is an empty pay-in port. On the other hand, when removal of the reject banknotes from the pay-out port 18 is detected (step S160: Yes), the controller 70 closes the pay-out port shutter 19 (step S162). The controller 70 then maintains a paused state 2 in which the pay-in port shutter 13 is open and the pay-out port shutter 19 is closed (step S164). Even if there are no reject banknotes stacked in the pay-out port 18 at step S154 (No), the controller 70 maintains the paused state 2 (step S164).

Since only the pay-in port shutter 13 is open in the paused state 2, the cashier is able to insert additional banknotes into the pay-in port 12 and remove banknotes from the pay-in port 12. If the banknotes are removed from the pay-in port 12 in the paused state 2 (step S166: Yes), the controller 70 returns to the processing of step S132, and performs the same processing as when the reason for stopping is an empty pay-in port. Note that when a count processing restart request from the cashier is detected in the paused state 2 (step S168: Yes), the controller 70 returns to the flow chart in FIG. 4 to close the pay-in port shutter 13 (step S108), and repeat the count processing (step S110).

Reason for Stopping: Impossible Conveyance to Temporary Holding Section

Figure 7:
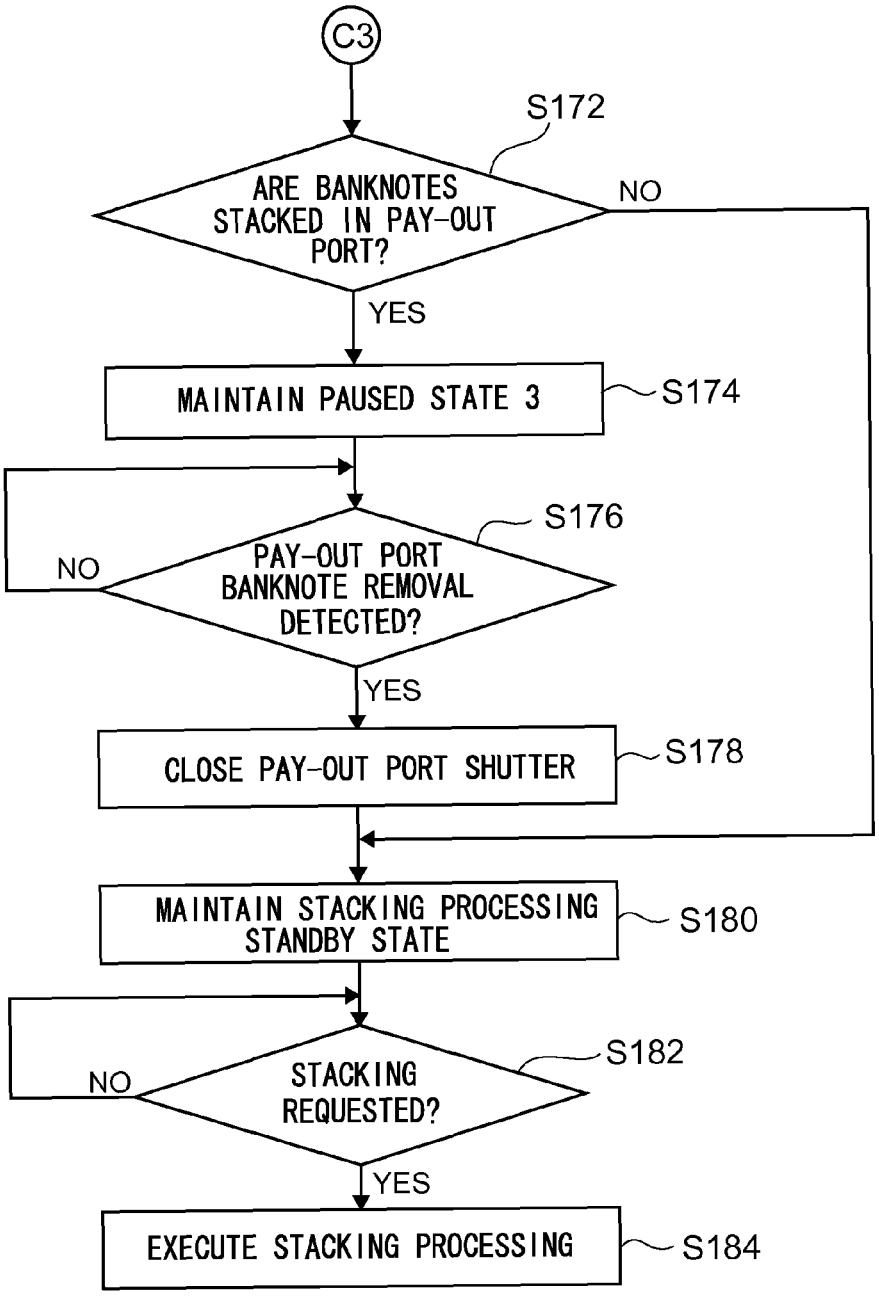
FIG. 7 is a flow chart illustrating an example of pay-in processing according to the first exemplary embodiment.

Explanation follows with reference to the flow chart in FIG. 7 regarding processing when the reason for stopping in count processing at step S122 is impossible conveyance to temporary holding section.

In the flow chart in FIG. 7, the controller 70 first determines whether or not any reject banknotes are stacked in the pay-out port 18 (step S172). When there are reject banknotes stacked in the pay-out port 18 at step S172 (Yes), the controller 70 maintains a paused state 3 in which the pay-in port shutter 13 and the pay-out port shutter 19 are both open (step S174). In the paused state 3, the cashier is able to insert additional banknotes into the pay-in port 12. Moreover, the cashier is able to remove banknotes stacked in the pay-in port 12 and reject banknotes stacked in the pay-out port 18.

If removal of reject banknotes from the pay-out port 18 is detected in the paused state 3 (step S176: Yes), the controller 70 closes the pay-out port shutter 19 (step S178). The controller 70 then maintains a stacking processing standby state in which the pay-in port shutter 13 is open and the pay-out port shutter 19 is closed (step S180). Note that since only the pay-in port shutter 13 is open in the stacking processing standby state, the cashier is able to insert additional banknotes into the pay-in port 12, and remove banknotes from the pay-in port 12.

If a stacking request by the cashier is detected in the stacking processing standby state (step S182: Yes), the controller 70 executes stacking processing to convey banknotes in the temporary holding section 22 to the banknote cassettes 30A to 30D (step S184).

1-6. Advantageous Effects of the First Exemplary Embodiment

According to the first exemplary embodiment described above, when a count processing stoppage event arises during count processing of banknotes inserted into the pay-in port 12, as illustrated in Fig. Fig. to FIG. 7, the count processing is paused and the pay-in port shutter 13 is opened. This allows the cashier to insert banknotes into the pay-in port 12 while the count processing is stopped. In other words, the cashier is able to insert additional banknotes into the pay-in port 12 before count processing has been completed for all of the banknotes previously inserted into the pay-in port 12, enabling efficient pay-in processing of large quantities of banknotes.

In the first exemplary embodiment, opening the pay-in port shutter 13 and the pay-out port shutter 19 when a count processing stoppage event occurs allows the cashier to remove any reject banknotes stacked in the pay-out port 18 while the count processing is stopped. Efficient pay-in processing is enabled since the reject banknotes can be reinserted into the pay-in port 12 while the count processing is stopped.

Note that although in the explanation given above, the pay-in port shutter 13 opens automatically when a count processing stoppage event occurs, the present exemplary embodiment is not limited thereto. For example, the cashier may manually open the closed pay-in port shutter 13 and insert additional banknotes into the pay-in port 12 when a count processing stoppage event occurs.

A press plate (not illustrated) that presses banknotes into alignment prior to feeding the banknotes out may be provided in the pay-in port 12. Such a press plate is configured so as to be capable of moving according to the number of inserted banknotes. In such a configuration, the cashier moves the press plate when manually opening the pay-in port shutter 13 in order to insert additional banknotes.

2. Second Exemplary Embodiment

The first exemplary embodiment enables insertion of additional banknotes into the pay-in port 12 when count processing is paused during pay-in processing. In the first exemplary embodiment, the reasons for pausing count processing are a count processing stoppage request, an empty pay-in port, impossible reject banknote conveyance, and impossible conveyance to temporary holding section.

The second exemplary embodiment similarly enables additional banknotes to be inserted into the pay-in port 12 by opening the pay-in port shutter 13 when count processing is paused. On the other hand, in the second exemplary embodiment the reasons for pausing count processing are different to those of the first exemplary embodiment. Specifically, in the second exemplary embodiment, the reasons for pausing count processing include conveyance of a reject banknote to the pay-out port 18 (reject banknote occurrence) in addition to the count processing stoppage request, empty pay-in port, and impossible conveyance to temporary holding section described above.

Namely, when the controller 70 detects the reject banknote occurrence during count processing, the feeding out of banknotes from the pay-in port 12 is paused. Note that any banknotes that are being conveyed on the conveyance path at this point in time are conveyed to a conveyance destination based on the classification result of the banknote identification section 20 before pausing count processing. Pausing count processing when a reject banknote is present prevents the pay-out port 18 from becoming full with reject banknotes. A state in which reject banknotes cannot be conveyed to the pay-out port 18 is accordingly prevented from arising.

Figure 8:
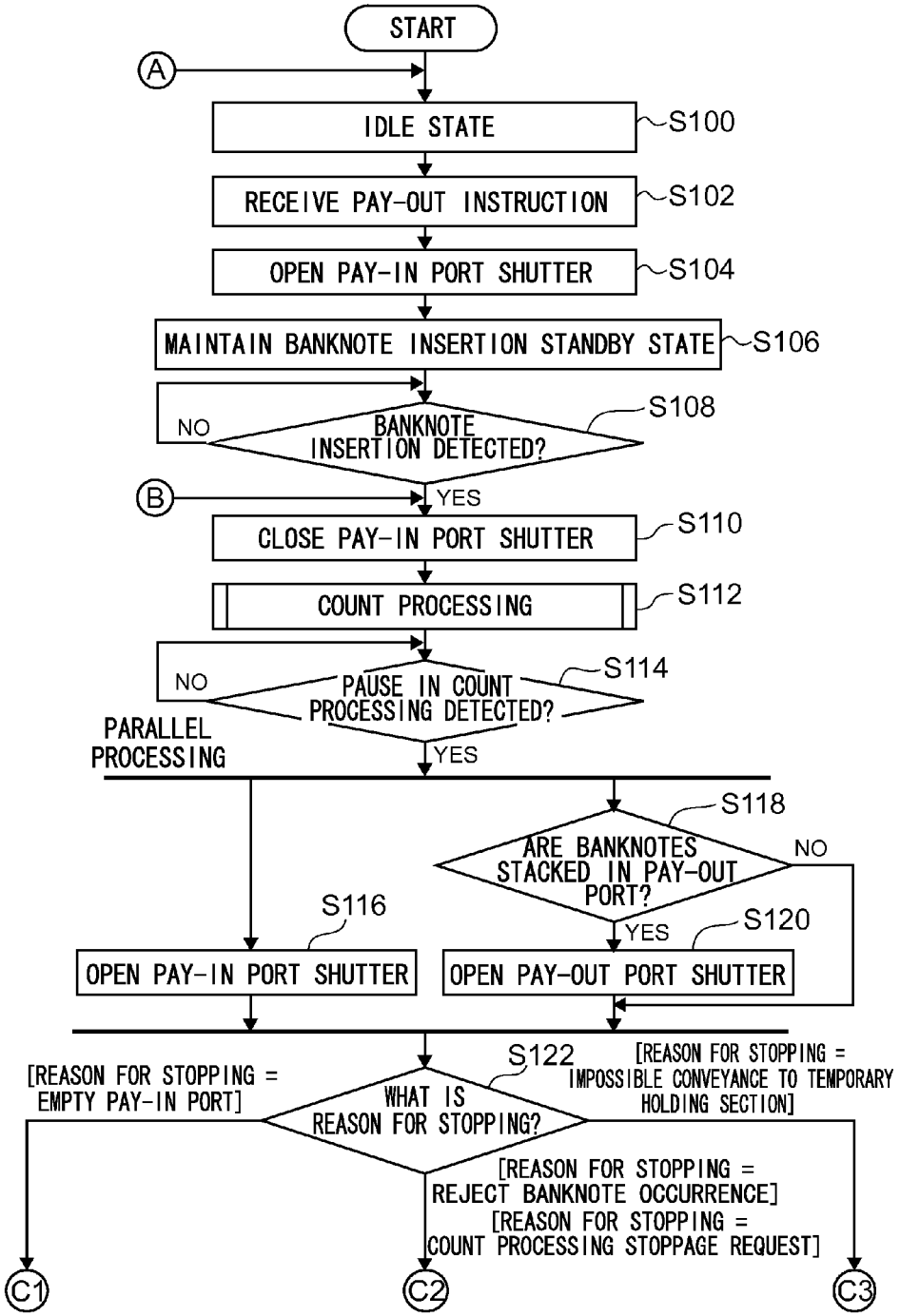
FIG. 8 is a flow chart illustrating an example of pay-in processing according to a second exemplary embodiment.

FIG. 8 is a flow chart illustrating an example of pay-in processing according to the second exemplary embodiment. The flow chart in FIG. 8 is substantially the same as the flow chart in FIG. 4. Explanation is given regarding only portions that differ from FIG. 4.

At step S122 in FIG. 8, the controller 70 determines the reason for pausing count processing. Namely, the controller 70 determines whether the reason for stopping is a count processing stoppage request, an empty pay-in port, reject banknote occurrence, or impossible conveyance to temporary holding section.

When the reason for stopping is the reject banknote occurrence, the controller 70 performs the above processing of FIG. 6. In the flow chart in FIG. 6, the cashier is able to remove and check the reject banknote that has been conveyed to the pay-out port 18 in the paused state 1 of step S156. Count processing can be repeated by reinserting the reject banknote removed by the cashier into the pay-in port 12.

Note that when the reason for stopping is a count processing stoppage request, an empty pay-in port, or impossible conveyance to temporary holding section, processing is performed similarly to in the first exemplary embodiment (see FIG. 5 to FIG. 7), and so detailed explanation thereof is omitted.

According to the second exemplary embodiment described above, the controller 70 pauses count processing when a reject banknote has been conveyed to the pay-out port 18. The cashier is accordingly able to remove the reject banknote stacked in the pay-out port 18 immediately while the count processing is stopped. Since the reject banknote can be checked, the reason for its rejection can be quickly ascertained. Moreover, banknote classification can be repeated by reinserting the removed reject banknote into the pay-in port 12.

3. Third Exemplary Embodiment 3-1. Banknote Processing Device Configuration Example The banknote processing device 10 according to the first exemplary embodiment includes a single pay-out port 18 (FIG. 1). In contrast thereto, a banknote processing device 10 according to a third exemplary embodiment includes plural pay-out ports (specifically, a first pay-out port 14 and a second pay-out port 15, as illustrated in FIG. 9).

Figure 9:
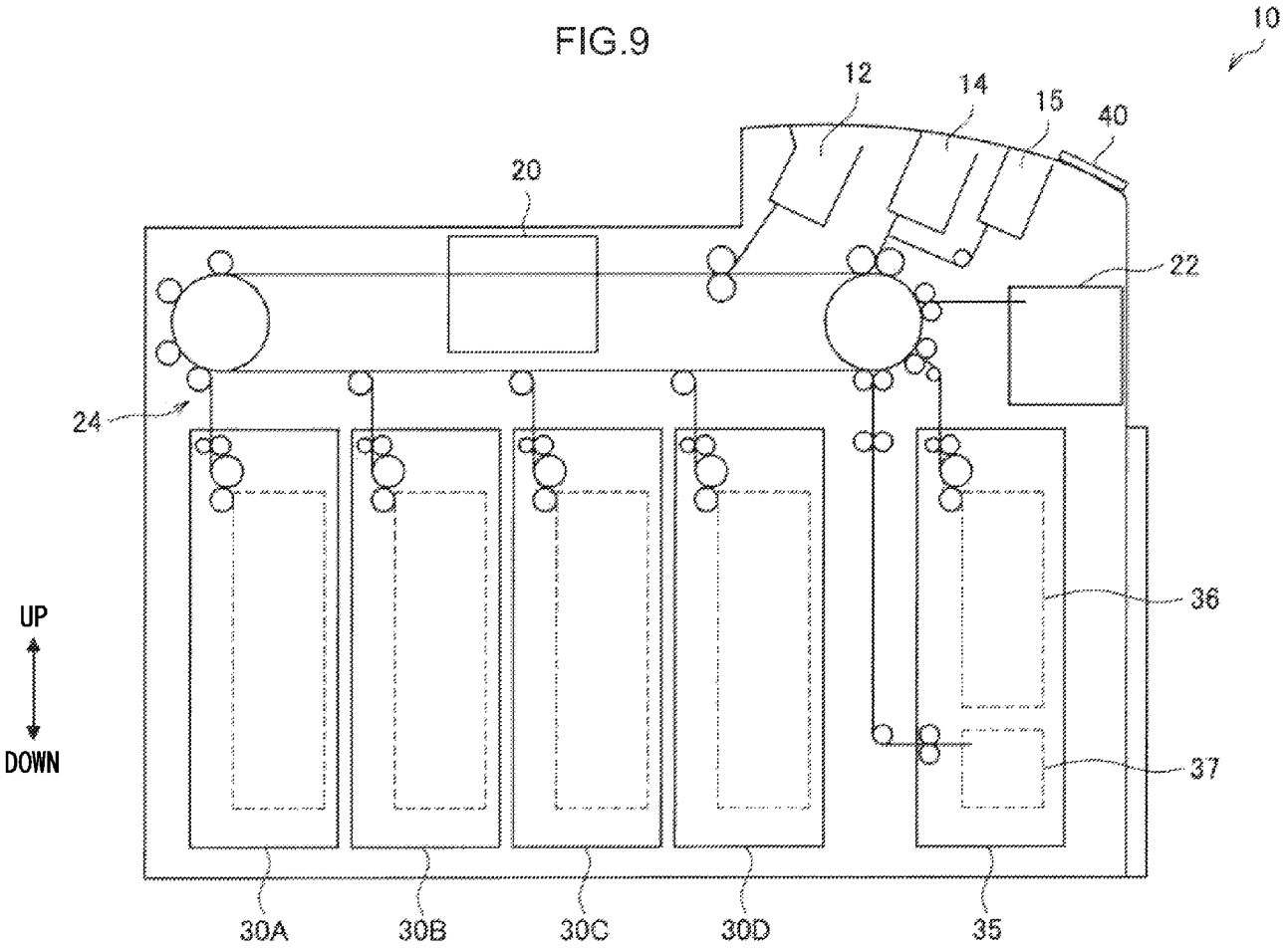
FIG. 9 is a drawing illustrating an example of an internal configuration of a banknote processing device 10 according to a third exemplary embodiment.

FIG. 9 illustrates an example of an internal configuration of the banknote processing device 10 according to the third exemplary embodiment. The first pay-out port 14 and the second pay-out port 15 each include a stacking function to stack dispensed banknotes. The first pay-out port 14 and the second pay-out port 15 each include, for example, sufficient capacity to stack 100 banknotes (a maximum stacking number). Two pay-out ports are provided in the example illustrated in FIG. 9; however the present invention is not limited thereto, and, for example, three or more pay-out ports may be provided. Note that as illustrated in FIG. 10A and FIG. 10B, a first pay-out port shutter (referred to below as the first shutter) 16 that opens and closes an opening portion of the first pay-out port 14, and a second pay-out port shutter (referred to below as the second shutter) 17 that opens and closes an opening portion of the second pay-out port 15, are respectively provided.

Figure 10A:
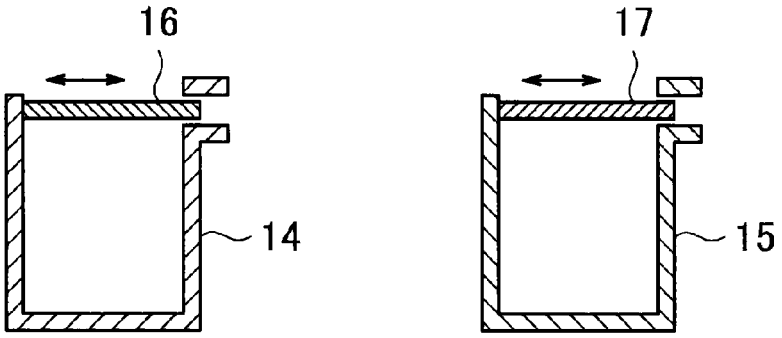
FIGS. 10A and 10B are schematic diagrams illustrating an example of configuration of a first shutter 16 and a second shutter 17.
Figure 10B:
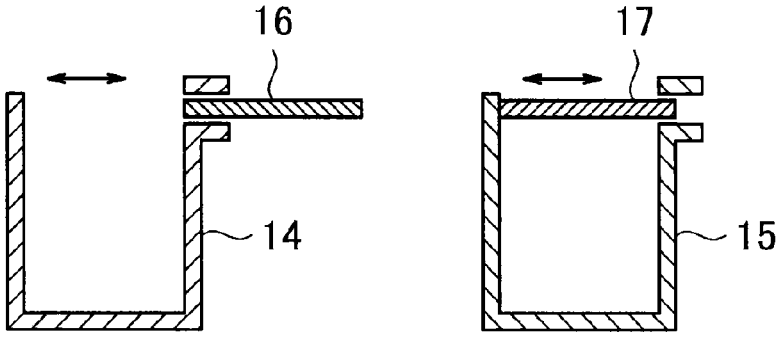

FIG. 10A and FIG. 10B are schematic diagrams illustrating an example of configuration of the first shutter 16 and the second shutter 17. FIG. 10A illustrates a closed state of the first shutter 16 and the second shutter 17, and FIG. 10B illustrates an open state of the first shutter 16. The first shutter 16 and the second shutter 17 respectively move in order to close the first pay-out port 14 and the second pay-out port 15. Note that the first shutter 16 is closed during conveyance of banknotes to the first pay-out port 14, and the second shutter 17 is closed during conveyance of banknotes to the second pay-out port 15. Note that in FIG. 10A and FIG. 10B, the flat plane shaped first shutter 16 and second shutter 17 are opened and closed by sliding, however curved plane shaped shutters may be opened and closed by turning.

The conveyance section 24 is controlled by the controller 70 and conveys banknotes to a target conveyance destination (for example the first pay-out port 14 or the second pay-out port 15). As an example, the conveyance section 24 includes a member such as a switching blade on the conveyance path, and the conveyance destination can be set to the first pay-out port 14 or the second pay-out port 15 by, for example, turning the switching blade.

In the third exemplary embodiment, the controller 70 alternately conveys reject banknotes to the first pay-out port 14 and the second pay-out port 15 when reject banknotes arise during count processing. Specifically, the controller 70 switches the reject banknote conveyance destination between the first pay-out port 14 and the second pay-out port 15 each time a reject is detected. The cashier is accordingly able to remove and check each reject banknote from the first pay-out port 14 or the second pay-out port 15, without stopping the count processing.

Other than the configuration described above, configuration of the banknote processing device 10 is similar to that of the first exemplary embodiment, and so detailed explanation thereof is omitted.

3-2. Pay-in Processing Example

Next, explanation follows regarding an example of pay-in processing according to the third exemplary embodiment, with reference to FIG. 11 to FIG. 14.

FIG. 11 to FIG. 14 are flow charts illustrating an example of pay-in processing according to the third exemplary embodiment. Similarly to the first exemplary embodiment explained in FIG. 4 to FIG. 7, the pay-in processing illustrated in FIG. 11 to FIG. 14 is normal pay-in processing, in which pay-in banknotes are held back in the temporary holding section 22 before being stacked from the temporary holding section 22 to the banknote cassettes 30A to 30D. The following explanation focuses on portions that differ from the flow charts illustrated in FIG. 4 to FIG. 7.

Figure 11:
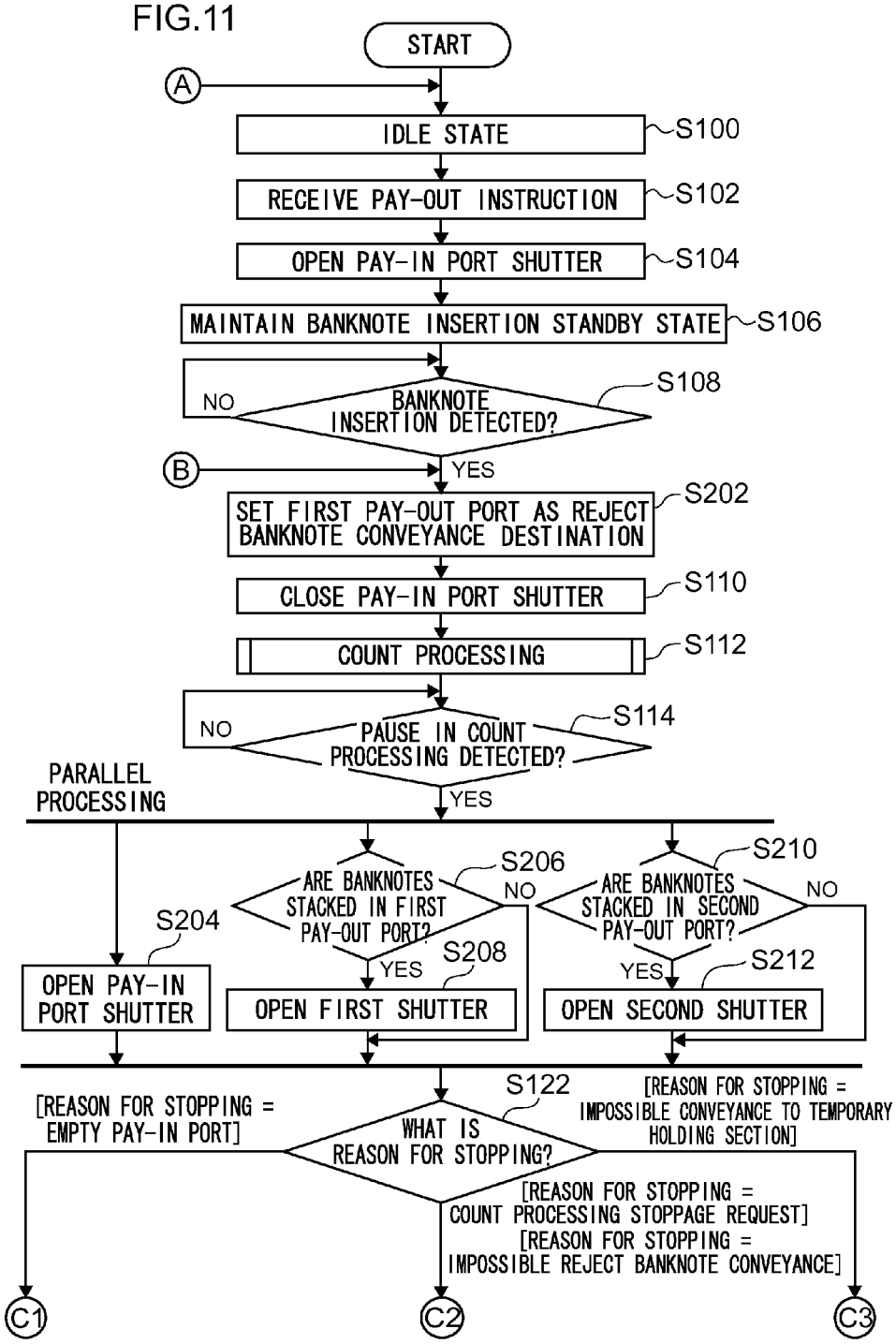
FIG. 11 is a flow chart illustrating an example of pay-in processing according to the third exemplary embodiment.

When the insertion of banknotes into the pay-in port 12 is detected at step S108 in FIG. 11 (Yes), the controller 70 sets one pay-out port out of the first pay-out port 14 and the second pay-out port 15 (the first pay-out port 14 in the present example) as the reject banknote conveyance destination (step S202). The controller 70 then closes the pay-in port shutter 13 (step S110), and executes the count processing illustrated in FIG. 15 (step S112).

Count Processing

Figure 15:
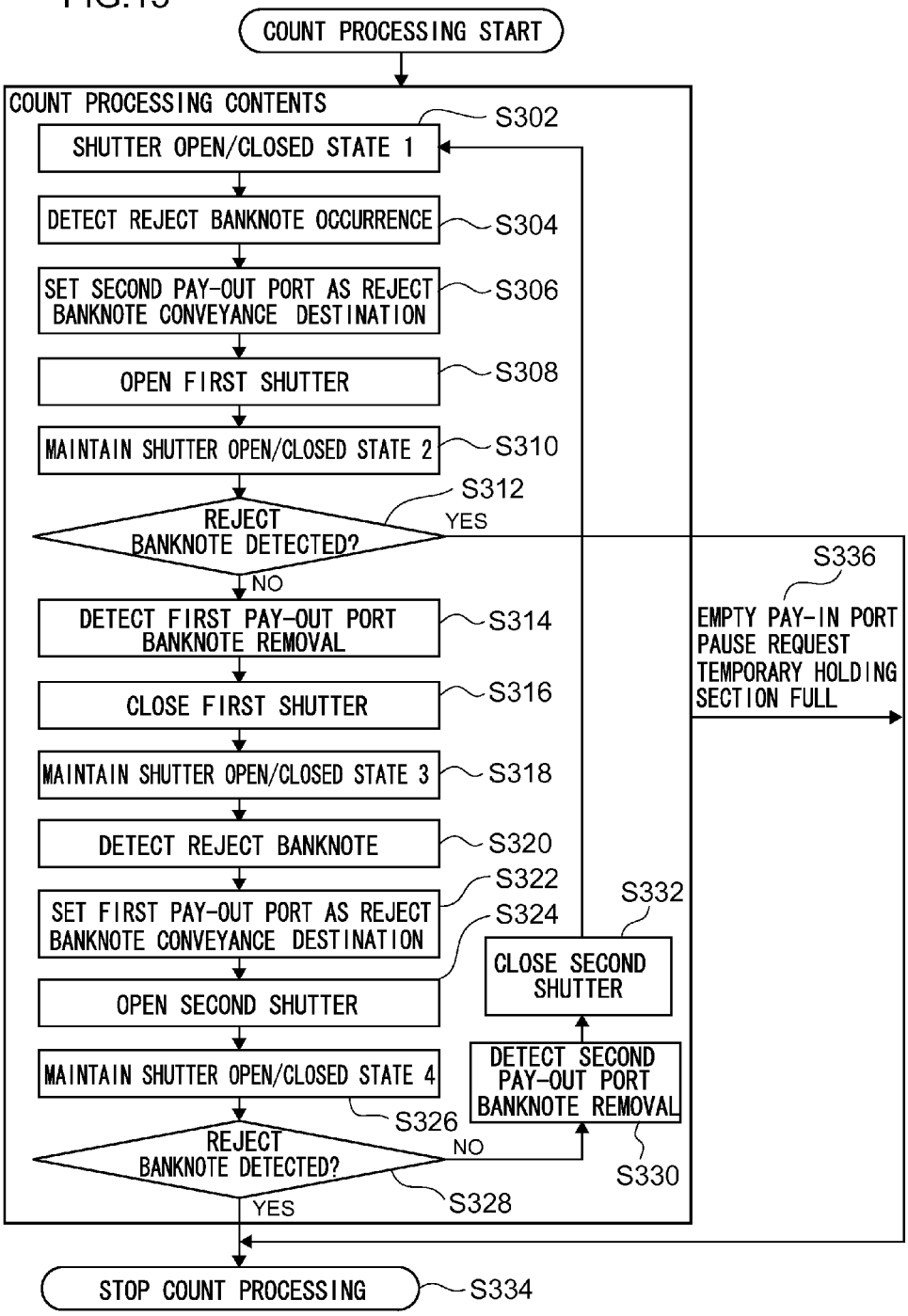
FIG. 15 is a flow chart illustrating an example of count processing of pay-in banknotes according to the third exemplary embodiment.

FIG. 15 is a flow chart illustrating an example of count processing of pay-in banknotes according to the third exemplary embodiment.

The count processing in FIG. 15 is started in a shutter open/closed state 1, in which the first shutter 16 and the second shutter 17 are both closed, and with the first pay-out port 14 set as the reject banknote conveyance destination (step S302). In the shutter open/closed state 1, the controller 70 feeds out and conveys the banknotes inserted into the pay-in port 12. Then, take a case in which the controller 70 detects the reject banknote occurrence (step S304).

When this occurs, the controller 70 stacks the reject banknote in the first pay-out port 14, and then switches the reject banknote conveyance destination to the second pay-out port 15 (step S306). For example, the controller 70 turns the switching blade in order to switch the conveyance destination, without stopping banknote conveyance. Subsequent reject banknotes are thus conveyed to the second pay-out port 15.

The controller 70 then opens the flat plane shaped first shutter 16 of the first pay-out port 14 in which the reject banknote is stacked (step S308). The controller 70 also maintains a shutter open/closed state 2 in which the first shutter 16 is open and the second shutter 17 is closed (step S310). When this is performed, the cashier is able to remove the reject banknote stacked in the first pay-out port 14.

In the shutter open/closed state 2, the second pay-out port 15 is set as the reject banknote conveyance destination. The controller 70 determines whether or not another reject banknote occurrence is detected before the reject banknote is removed from the first pay-out port 14 (step S312). When the reject banknote occurrence is detected at step S312 (Yes), the controller 70 stops count processing (step S334). Namely, the controller 70 stops feeding banknotes out from the pay-in port 12, and count processing is stopped once any banknotes that are being conveyed at this point in time have been conveyed to their conveyance destination based on the classification results.

On the other hand, when removal of the reject banknote from the first pay-out port 14 is detected (step S314) before another reject banknote arises (step S312: No), the controller 70 closes the first shutter 16 (step S316). The controller 70 maintains a shutter open/closed state 3 in which the first shutter 16 and the second shutter 17 are both closed (step S318). At this point, the reject banknote conveyance destination is the second pay-out port 15.

Then, when the controller 70 detects the reject banknote occurrence in the shutter open/closed state 3 (step S320), the controller 70 switches the reject banknote conveyance destination to the first pay-out port 14 (step S322), and opens the second shutter 17 (step S324). The controller 70 then maintains a shutter open/closed state 4 in which the first shutter 16 is closed and the second shutter 17 is open (step S326). When this is performed, the cashier is able to remove the reject banknote stacked in the second pay-out port 15.

The reject banknote conveyance destination is set to the first pay-out port 14 in the shutter open/closed state 4. The controller 70 determines whether or not another reject banknote occurrence is detected before the reject banknote has been removed from the first pay-out port 14 (step S328). When a reject banknote occurrence is detected at step S328 (Yes), the controller 70 stops count processing (step S334).

On the other hand, when removal of the reject banknote from the second pay-out port 15 is detected (step S330) before another reject banknote occurs (step S328: No), the controller 70 closes the second shutter 17 (step S332). The controller 70 maintains the shutter open/closed state 1 in which the first shutter 16 and the second shutter 17 are both closed (step S302).

Note that the controller 70 stops the count processing (step S334) when any reason for stopping, out of a count processing stoppage request, an empty pay-in port, or an impossible conveyance to temporary holding section, arises during the count processing (step S336).

The processing of the flow chart in FIG. 15 is repeated until count processing stops. When count processing has stopped, processing returns to the flow chart in FIG. 11 and pay-in processing continues. The controller 70 performs processing to operate the pay-in port shutter 13, the first shutter 16, and the second shutter 17 in parallel when a pause in count processing is detected (step S114: Yes).

Namely, the controller 70 opens the pay-in port shutter 13 (step S204). The controller 70 also determines whether or not a reject banknote has been stacked in the first pay-out port 14 (step S206). If a reject banknote is indeed stacked in the first pay-out port 14 at step S206 (Yes), the controller 70 opens the first shutter 16 (step S208). The controller 70 also determines whether or not a reject banknote has been stacked in the second pay-out port 15 (step S210), and if a reject banknote has indeed been stacked in the second pay-out port 15 at step S210 (Yes), the controller 70 opens the second shutter 17 (step S212). When this is performed, the controller 70 opens the pay-in port shutter 13 and the first shutter 16 (or the second shutter 17) at the same time as each other.

Next, the controller 70 determines the reason for pausing the count processing (step S122). Namely, the controller 70 determines whether the reason for stopping is a count processing stoppage request, an empty pay-in port, impossible reject banknote conveyance, or impossible conveyance to temporary holding section. The controller 70 then performs processing according to the reason for stopping, similarly to in the first exemplary embodiment.

Reason for Stopping: Empty Pay-in Port

Figure 12:
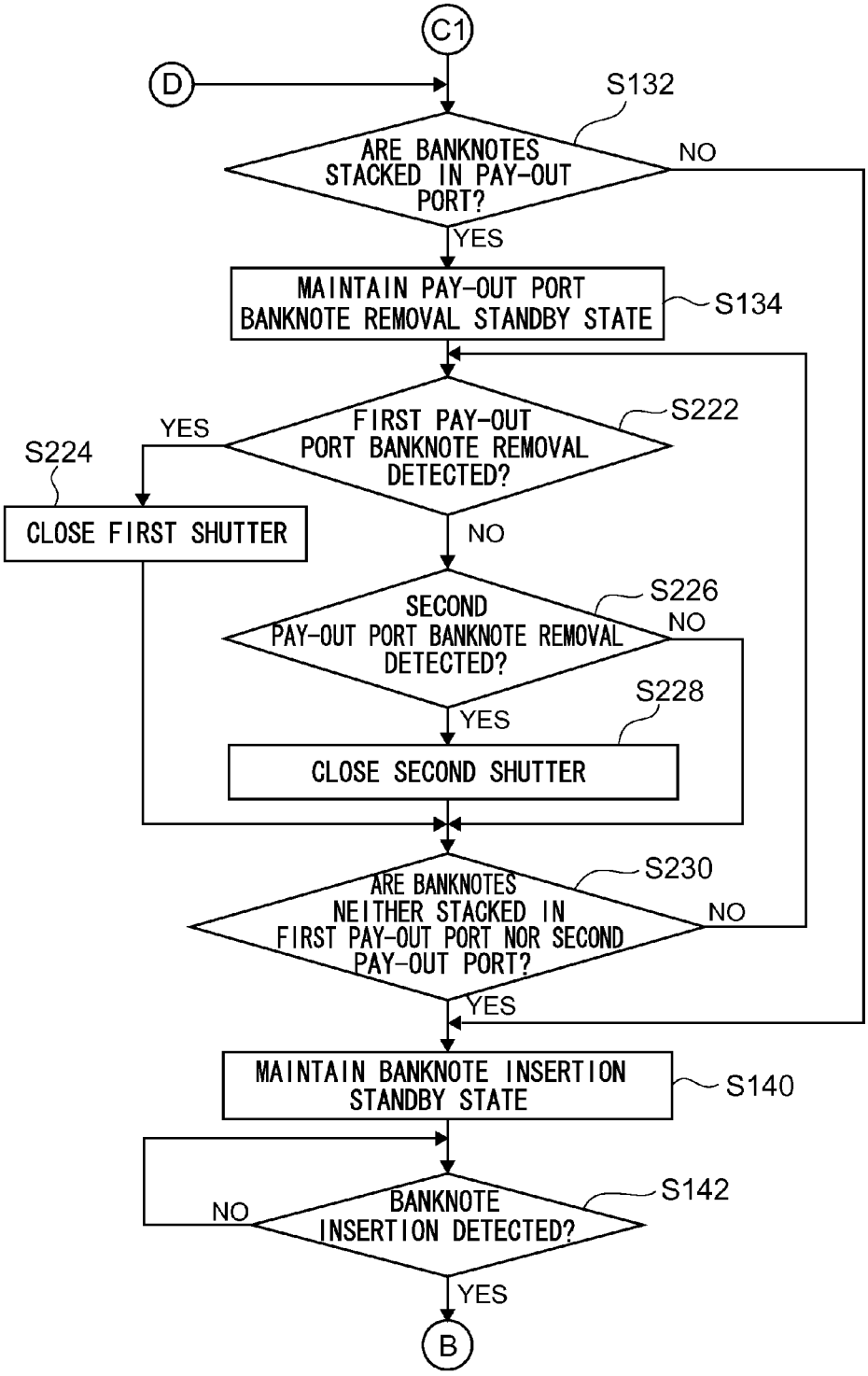
FIG. 12 is a flow chart illustrating an example of pay-in processing according to the third exemplary embodiment.
Figure 13:
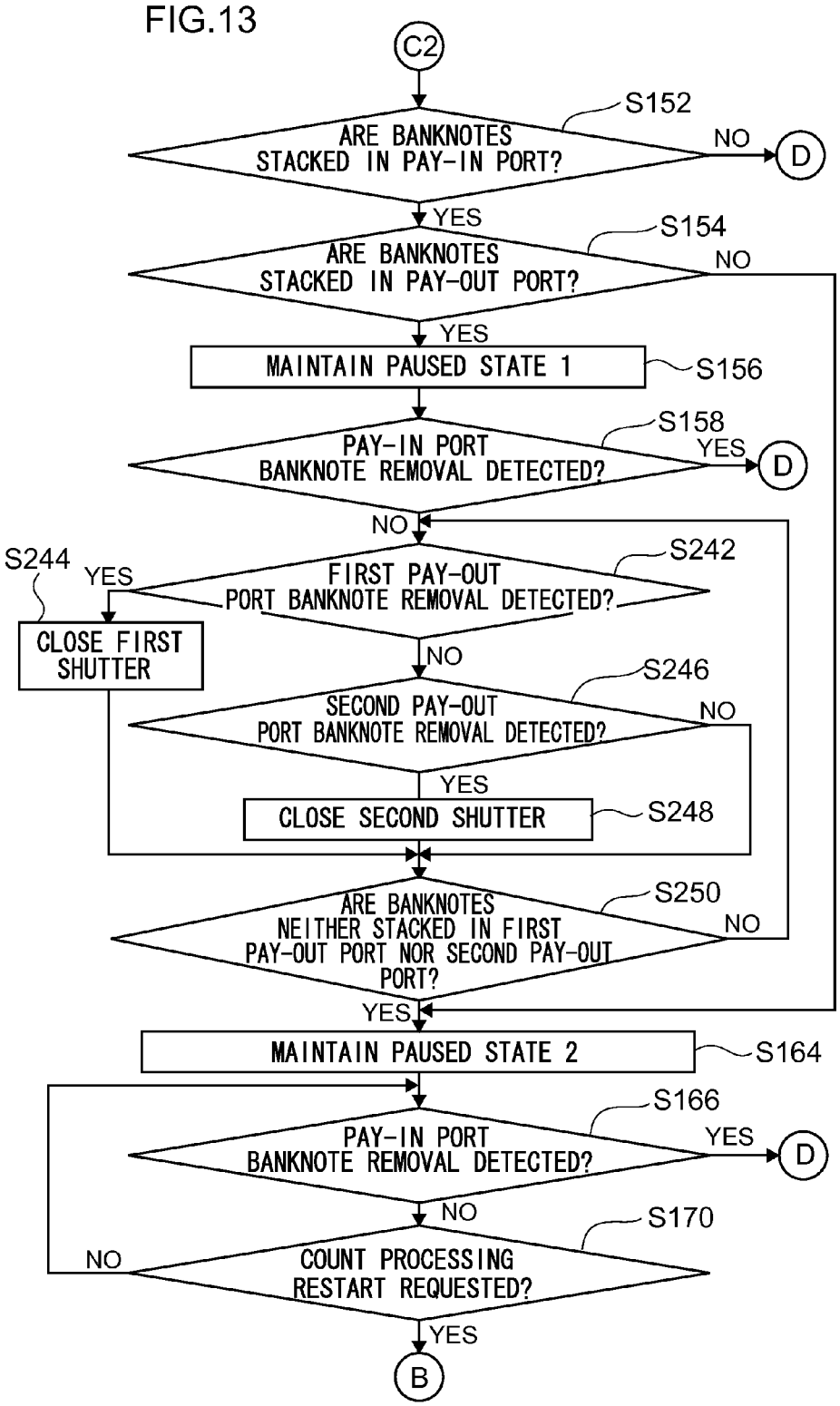
FIG. 13 is a flow chart illustrating an example of pay-in processing according to the third exemplary embodiment.

Explanation follows with reference to the flow chart in FIG. 12 regarding processing when the reason for stopping count processing at step S122 is an empty pay-in port. Explanation focuses on portions that differ from the flow chart in FIG. 5.

In a pay-out port banknote removal standby state at step S134 in FIG. 12, the controller 70 closes the first shutter 16 (step S224) when removal of a reject banknote from the first pay-out port 14 has been detected (step S222: Yes). Similarly, the controller 70 closes the second shutter 17 (step S228) when removal of a reject banknote from the second pay-out port 15 has been detected (step S226: Yes). Note that the controller 70 does not close the first shutter 16 or the second shutter 17 if reject banknote removal is not detected (step S222: No, S226: No).

The controller 70 then repeats the processing of steps S222 to S228 described above until detection is made that reject banknotes are neither stacked in the first pay-out port 14 nor the second pay-out port 15 (step S230: Yes). Subsequent processing is similar to that in the flow chart in FIG. 5, and so detailed explanation thereof is omitted.

Reason for Stopping: Count Processing Stoppage Request, or Impossible Reject Banknote Conveyance Explanation follows with reference to the flow chart in FIG. 13 regarding processing when the reason for stopping count processing at step S122 is a count processing stoppage request or impossible reject banknote conveyance. Explanation focuses on portions that differ from the flow chart in FIG. 6.

The controller 70 closes the first shutter 16 (step S244) if removal of the reject banknote from the first pay-out port 14 is detected (step S242: Yes) in the paused state 1 of step S156 in FIG. 13. Similarly, the controller 70 closes the second shutter 17 (step S248) if removal of the reject banknote from the second pay-out port 15 is detected (step S246: Yes).

The controller 70 repeats the processing of steps S242 to S248 described above until detection is made that reject banknotes are neither stacked in the first pay-out port 14 nor the second pay-out port 15 (step S250: Yes). Subsequent processing is similar to that of the flow chart in FIG. 6, and so detailed explanation thereof is omitted.

Reason for Stopping: Impossible Conveyance to Temporary Holding Section

Figure 14:
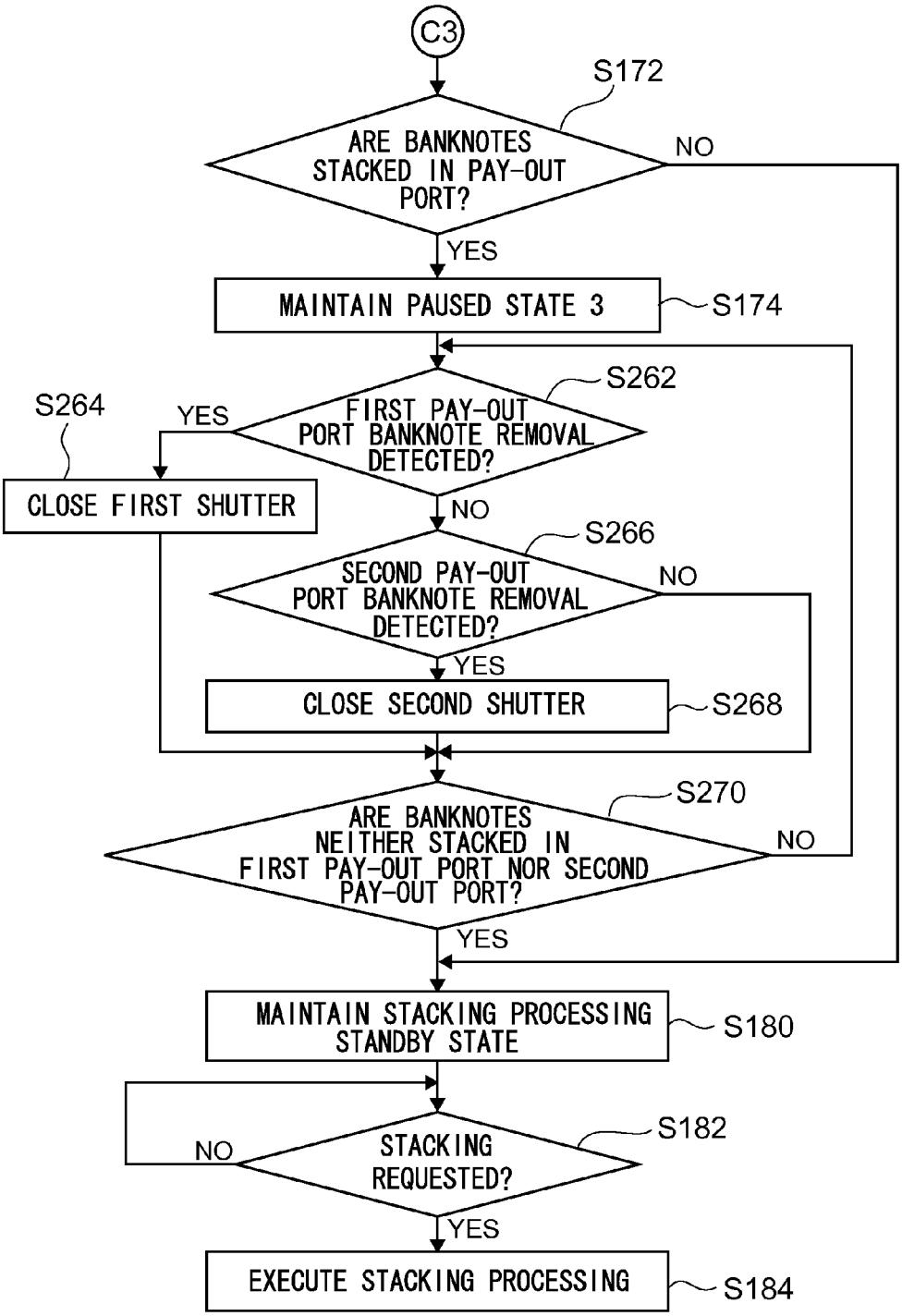
FIG. 14 is a flow chart illustrating an example of pay-in processing according to the third exemplary embodiment.

Explanation follows with reference to the flow chart in FIG. 14 regarding processing when the reason for stopping count processing at step S122 is impossible conveyance to temporary holding section. Explanation focuses on portions that differ from the flow chart in FIG. 7.

The controller 70 closes the first shutter 16 (step S264) if removal of the reject banknote from the first pay-out port 14 is detected (step S262: Yes) in the paused state 3 of step S174 in FIG. 14. Similarly, the controller 70 closes the second shutter 17 (step S268) if removal of the reject banknote from the second pay-out port 15 is detected (step S266: Yes).

The controller 70 repeats the processing of steps S262 to S268 described above until detection is made that reject banknotes are neither stacked in the first pay-out port 14 nor the second pay-out port 15 (step S270: Yes). Subsequent processing is similar to that of the flow chart in FIG. 7, and so detailed explanation thereof is omitted.

As illustrated in FIG. 15, according to the third exemplary embodiment described above, when reject banknotes arise during count processing, the reject banknotes are alternately conveyed to the first pay-out port 14 and the second pay-out port 15. This enables the cashier to remove and check the reject banknotes from the first pay-out port 14 or the second pay-out port 15, without stopping the count processing.

4. Fourth Exemplary Embodiment 4-1. Banknote Processing Device Configuration Example A banknote processing device 10 according to a fourth exemplary embodiment includes a pay-in port 12, a pay-out port 18, a pay-in port shutter 13, and a pay-out port shutter 19, similarly to the first exemplary embodiment.

Figure 16:
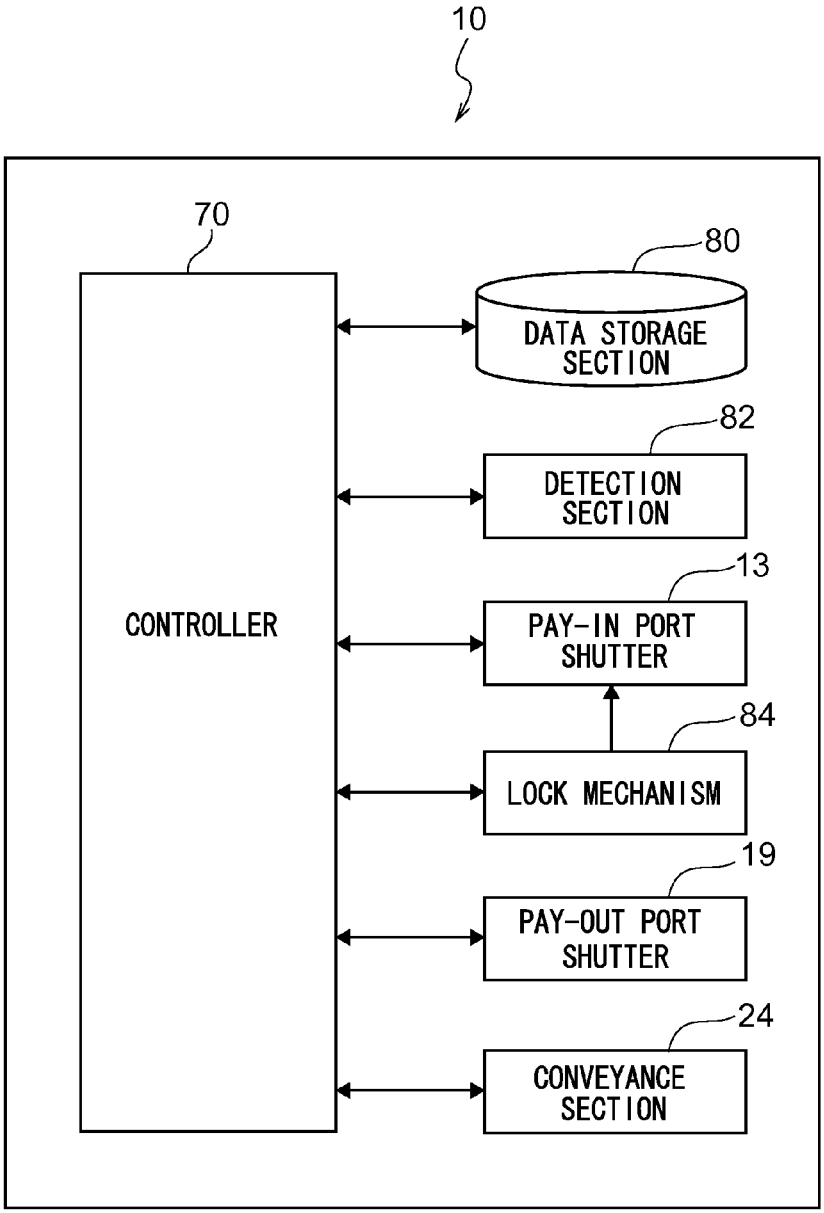
FIG. 16 is a block diagram illustrating an example of a functional configuration of a banknote processing device 10 according to a fourth exemplary embodiment.

Unlike the first to third exemplary embodiments, in the banknote processing device 10 according to the fourth exemplary embodiment, the pay-in port shutter 13 includes a lockable lock mechanism 84 (see FIG. 16). This prevents the cashier from manually opening the pay-in port shutter 13 while the pay-in port shutter 13 is locked, and allows the cashier to manually open the pay-in port shutter 13 when locking is released. Note that the lock mechanism 84 may also be provided in the first to third exemplary embodiments.

FIG. 16 is a block diagram illustrating an example of functional configuration of the banknote processing device 10 according to the fourth exemplary embodiment. As illustrated in FIG. 16, in the fourth exemplary embodiment the controller 70 controls operation of the lockable lock mechanism 84, as well as conveyance by the conveyance section 24 and the opening and closing operations of the pay-in port shutter 13 and the pay-out port shutter 19.

The controller 70 locks the pay-in port shutter 13 with the lock mechanism 84 during count processing. However, the controller 70 releases the locked state of the pay-in port shutter 13, that is in a closed state, during conveyance of banknotes from the pay-in port 12 to the banknote cassettes 30A to 30D (specifically, during stacking processing of banknotes in the temporary holding section 22). This enables the cashier to manually open the pay-in port shutter 13, of which the locked state has been released, and insert additional banknotes into the pay-in port 12 during stacking processing. Moreover, since the pay-in port shutter 13 is in a closed state, operation noise and the like of the banknote processing device 10 can be prevented from escaping to the outside.

Note that in the above explanation, the locked state of the pay-in port shutter 13 is released during stacking processing, however the controller 70 may, for example, release the locked state of the pay-in port shutter 13, that is in a closed state, by the locking mechanism during direct pay-in processing in which banknotes are conveyed from the pay-in port 12 to the banknote cassettes 30A to 30D.

4-2. Pay-in Processing Example

Explanation follows regarding an example of pay-in processing according to the fourth exemplary embodiment, with reference to FIG. 17 to FIG. 20.

FIG. 17 to FIG. 20 are flow charts illustrating an example of pay-in processing according to the fourth exemplary embodiment. Similarly to the first exemplary embodiment explained in FIG. 4 to FIG. 7, the pay-in processing illustrated in FIG. 17 to FIG. 20 is normal pay-in processing, in which pay-in banknotes are first held back in the temporary holding section 22 before being stacked in the banknote cassettes 30A to 30D from the temporary holding section 22. The following explanation focuses on portions that differ from the flow charts illustrated in FIG. 4 to FIG. 7.

Figure 17:
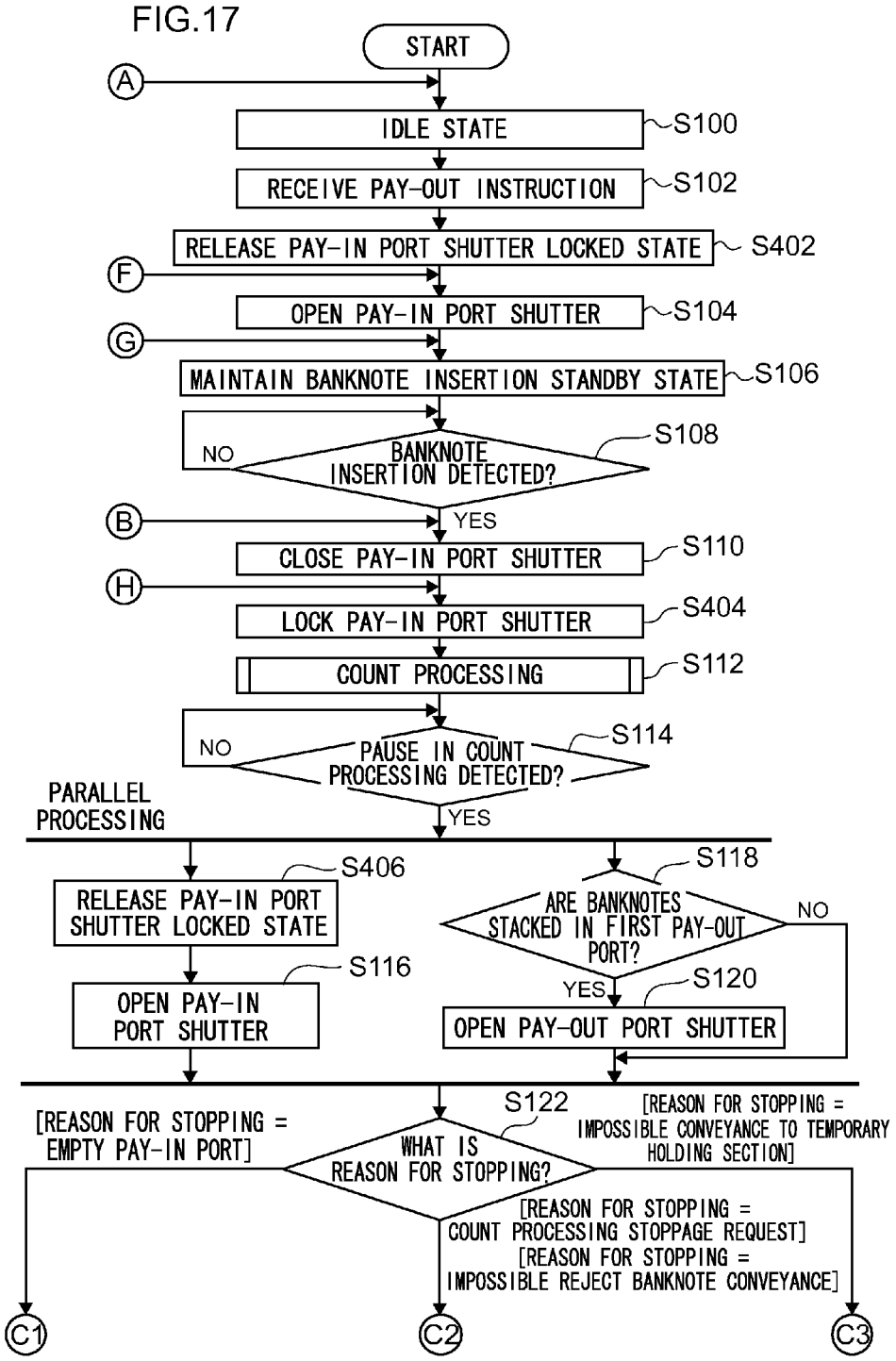
FIG. 17 is a flow chart illustrating an example of pay-in processing according to the fourth exemplary embodiment.

On receipt of a pay-in processing instruction at step S102 in FIG. 17, the controller 70 releases the locked state of the pay-in port shutter 13 (step S402), and opens the pay-in port shutter 13 (step S104). Then, when insertion of banknotes to the pay-in port 12 has been detected (step S108: Yes), the controller 70 closes the pay-in port shutter 13 (step S110) and locks the pay-in port shutter 13 (step S404). The controller 70 then performs count processing for the pay-in banknotes (step S112).

In the fourth exemplary embodiment, similarly to the first exemplary embodiment, when the controller 70 detects that count processing has been paused due to any out of a count processing stoppage request, an empty pay-in port, impossible reject banknote conveyance, or impossible conveyance to temporary holding section (step S114: Yes), the controller 70 performs processing to operate the pay-in port shutter 13 and the pay-out port shutter 19 in parallel.

That is, the controller 70 releases the locked state of the pay-in port shutter 13 (step S406), and opens the pay-in port shutter 13 (step S116). The controller 70 also determines whether or not any reject banknotes are stacked in the pay-out port 18 (step S118), and if reject banknotes are indeed stacked in the pay-out port 18 at step S118 (Yes), the controller 70 opens the pay-out port shutter 19 (step S120). When this is performed, the controller 70 opens the pay-in port shutter 13 and the pay-out port shutter 19 at the same time as each other.

Next, the controller 70 determines the reason for pausing count processing (step S122), and performs processing according to the reason for stopping as explained below.

Reason for Stopping: Empty Pay-in Port

Figure 18:
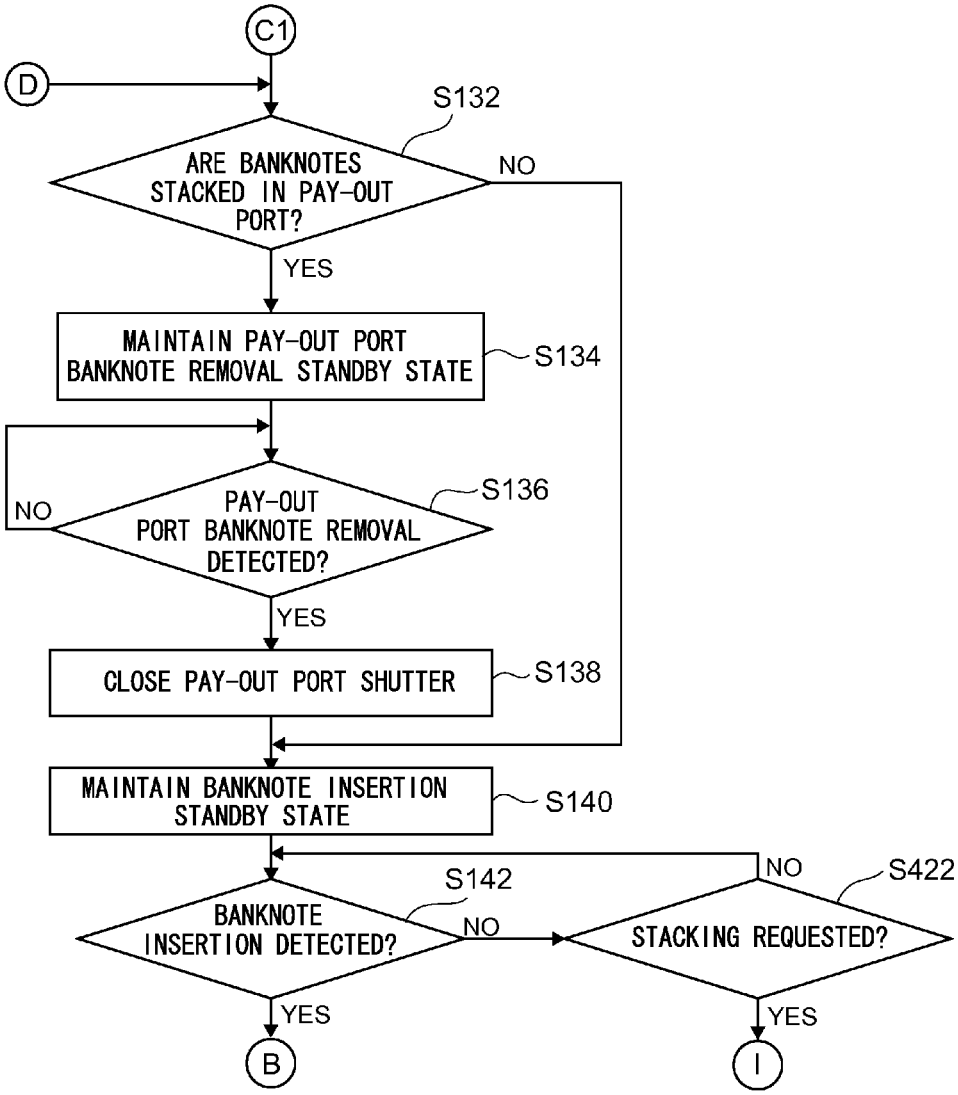
FIG. 18 is a flow chart illustrating an example of pay-in processing according to the fourth exemplary embodiment.

Explanation follows with reference to the flow chart in FIG. 18 regarding processing when the reason for stopping count processing at step S122 is an empty pay-in port. The following explanation focuses on portions that differ from the flow chart illustrated in FIG. 5.

In the banknote insertion standby state at step S140 in FIG. 18, on detection of banknote insertion into the pay-in port 12 (step S142: Yes), the controller 70 returns to the processing of the flow chart illustrated in FIG. 17 and closes the pay-in port shutter 13 (step S110). However, when a stacking processing request is made (step S442: Yes) without inserting banknotes into the pay-in port 12 (step S142: No), the controller 70 proceeds to the flow chart illustrated in FIG. 19, described later, closes the pay-in port shutter 13 (step S442), and performs stacking processing (step S184).

During stacking processing, the pay-in port shutter 13 is closed, however the locked state of the pay-in port shutter 13 is released. The cashier is thus able to manually open and close the pay-in port shutter 13 during stacking processing, enabling insertion of additional banknotes into the pay-in port 12.

Reason for Stopping: Count Processing Stoppage Request or Impossible Reject Banknote Conveyance When the reason for stopping count processing at step S122 is a count processing stoppage request or impossible reject banknote conveyance, the processing illustrated in the flow chart in FIG. 6 described above is performed. Detailed explanation thereof is accordingly omitted.

Reason for Stopping: Impossible Conveyance to Temporary Holding Section

Figure 19:
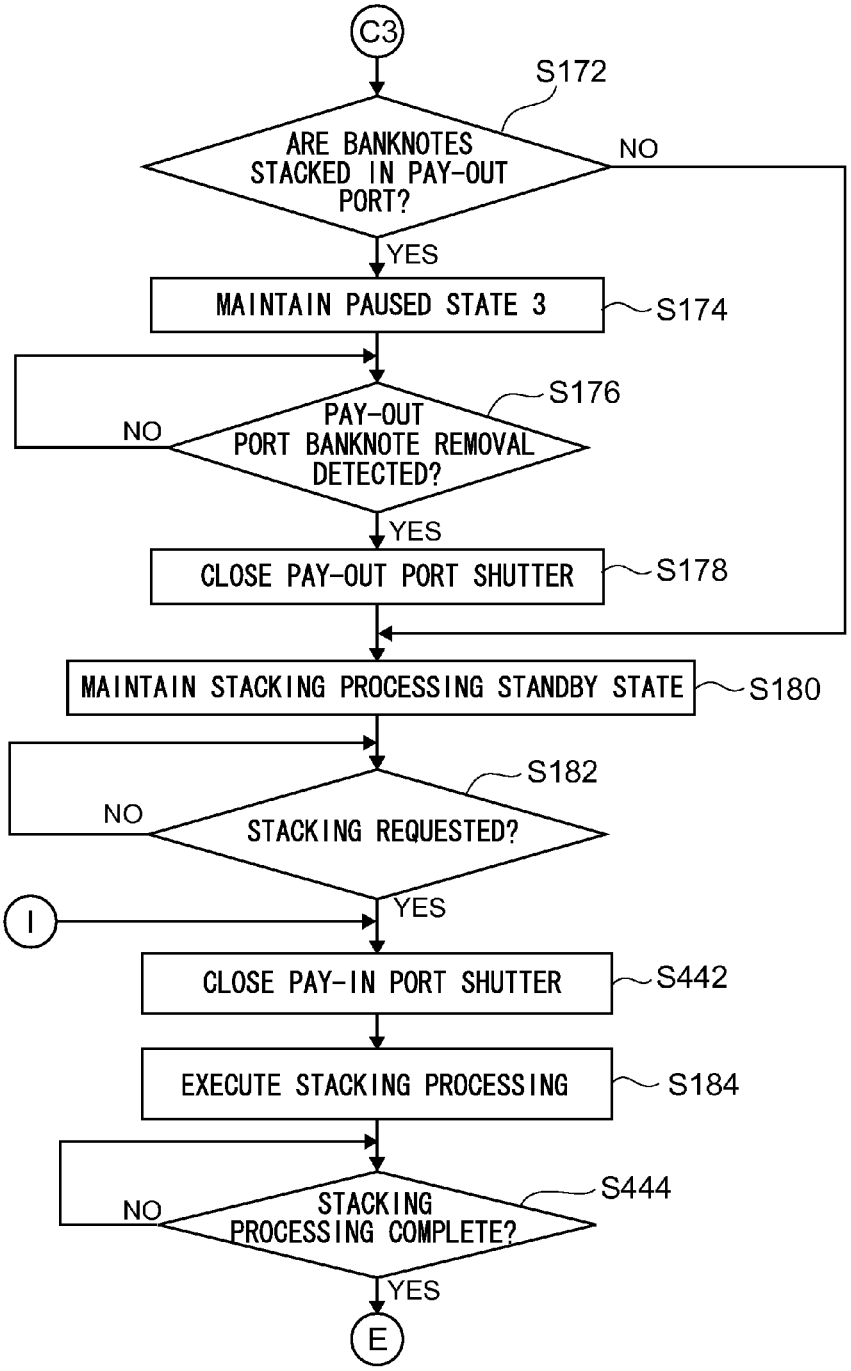
FIG. 19 is a flow chart illustrating an example of pay-in processing according to the fourth exemplary embodiment.
Figure 20:
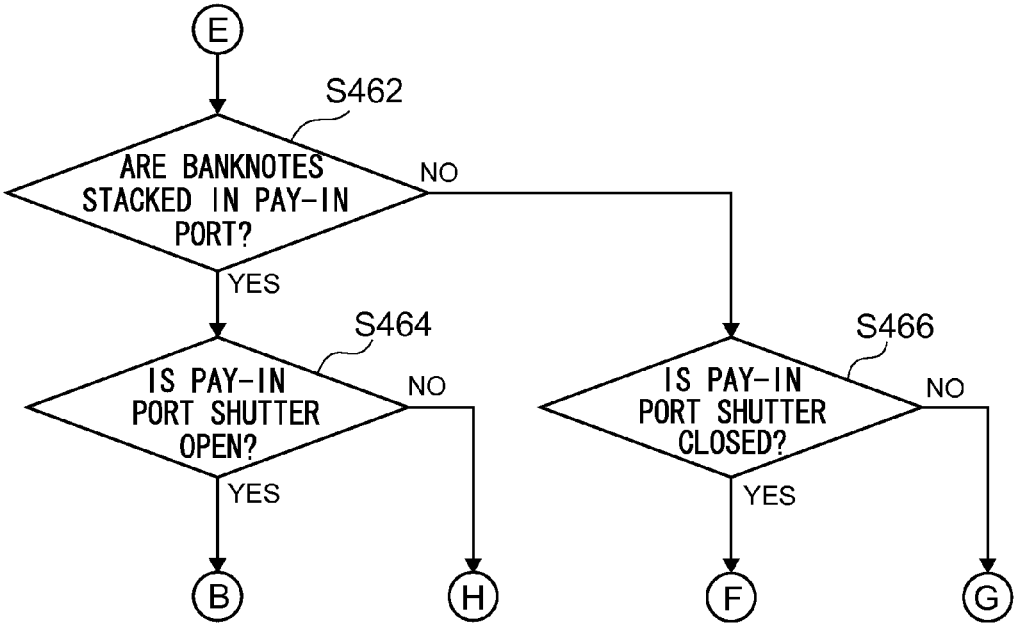
FIG. 20 is a flow chart illustrating an example of pay-in processing according to the fourth exemplary embodiment.

Explanation follows with reference to the flow charts in FIG. 19 and FIG. 20 regarding processing when the reason for stopping count processing at step S122 is impossible conveyance to temporary holding section. The following explanation focuses on portions that differ from the flow chart illustrated in FIG. 7.

When the controller 70 detects a stacking processing request in the stacking processing standby state of step S180 in FIG. 19 (step S182: Yes), the controller 70 closes the pay-in port shutter 13 (step S442), and executes stacking processing (step S184). Since the locking of the pay-in port shutter 13 is released during stacking processing, as described above, the cashier is able to insert additional banknotes into the pay-in port 12. Then, when the stacking processing ends (step S444: Yes), as illustrated in FIG. 20, the controller 70 determines whether or not banknotes are stacked in the pay-in port 12, and also determines the open/closed state of the pay-in port shutter 13 (steps S462, S464, S466).

If there are banknotes stacked in the pay-in port 12 (Yes) at step S462 and the pay-in port shutter 13 is open (Yes) at step S464, the controller 70 returns to the flow chart in FIG. 17, closes the pay-in port shutter 13 (S110), and locks the pay-in port shutter 13 (step S404). On the other hand, if the pay-in port shutter 13 is closed at step S464 (No), the controller 70 locks the pay-in port shutter 13 (step S404).

On the other hand, if banknotes are not stacked in the pay-in port 12 (No) at step S462 and the pay-in port shutter 13 is closed (Yes) at step S466, the controller 70 returns to the flow chart in FIG. 17, opens the pay-in port shutter 13 (step S104), and maintains the banknote insertion standby state (step S106). On the other hand, if the pay-in port shutter 13 is open (No) at step S466, the controller 70 maintains the banknote insertion standby state (step S106).

According to the fourth exemplary embodiment described above, during conveyance of banknotes from the pay-in port 12 to the banknote cassettes 30A to 30D (specifically, during stacking processing of banknotes in the temporary holding section 22), the locked state of the pay-in port shutter 13, that is in a closed state, is released. The cashier is thus able to insert additional banknotes into the pay-in port 12 during stacking processing, while preventing operation noise and the like of the banknote processing device 10 from escaping to the outside.

Note that after stacking processing to the banknote cassettes 30A to 30D has been completed, processing to feed out the banknotes inserted into the pay-in port 12 is normally executed by the cashier selecting pay-in processing start. However, there is no limitation thereto, and if there are banknotes stacked in the pay-in port 12 at completion of stacking processing, the banknotes may be fed out from the pay-in port 12 automatically. Moreover, the cashier may select in advance whether or not to execute a feed-out operation automatically once stacking processing has completed. For example, configuration may be made such that a banknote feed-out operation is automatically executed after stacking processing has completed when the cashier presses a selectable reservation button in advance.

5. Summary

The banknote processing devices 10 according to the exemplary embodiments described above are configured such that the pay-in port shutter 13 opens, or that the pay-in port shutter 13 is placed in a closed state that may be manually opened, when a stoppage event (such as a reason for stopping count processing) arises in which banknote conveyance is stopped partway.

Accordingly, when a stoppage event arises, the pay-in port shutter 13 opens, or the pay-in port shutter may be manually opened, enabling insertion of banknotes into the pay-in port 12 while banknote conveyance is stopped. This enables additional banknotes to be inserted into the pay-in port 12 before all of the banknotes previously inserted into the pay-in port 12 have been processed, thus enabling efficient pay-in processing of large quantities of banknotes.

Although detailed explanation regarding preferable exemplary embodiments of the present invention has been given above with reference to the attached drawings, the present invention is not limited to these examples. It would be clear to a practitioner familiar with the technical field of the present invention that various modifications and adjustments may be implemented within the scope of the technical concept recited in the claims, and any such modifications and adjustments are obviously included within the technical scope of the present invention.

The respective processing steps of the banknote processing device 10 described above need not be performed in a time sequence matching the sequence illustrated in the flow charts. For example, the respective processing steps of the banknote processing device 10 may be formed in a different sequence to the sequence illustrated in the flow charts, or may be performed parallel to each other.

Moreover, a computer program may be produced that causes hardware such as a CPU, ROM and RAM installed in the banknote processing device 10 to perform functions equivalent to the respective configurations of the banknote processing device 10 described above.

Moreover, in the exemplary embodiments described above, explanation has been given in which the banknote processing device 10 is applied to a cashier-operated terminal, however there is no limitation thereto. For example, application may be made to a cash processing section of an automated transaction device exemplified by an Automated Teller Machine (ATM) that cycles (recycles) banknotes, and that is a customer-operated terminal. Automated transaction devices are installed in a wide range of locations, such as in banks, railway stations and convenience stores. A customer can perform transactions such as deposits, withdrawals, and balance enquiries by performing various operations using a display screen displayed by the automated transaction device.

The invention claimed is:

1. A banknote processing device, comprising:
a pay-in port configured to receive banknotes;
a conveyance section configured to convey the banknotes received through the pay-in port;
a pay-in port opening-closing member configured to move to open and close the pay-in port; and
a controller configured
to control the banknote conveyance of the conveyance section and the opening and closing operation of the pay-in port opening-closing member, and
to control count processing via which the received banknotes are counted;
a banknote classification section that classifies the banknote during the count processing; and
a first pay-out port and a second pay-out port to which reject banknotes classified by the banknote classification section are conveyed, wherein
the controller, upon detecting a count processing stoppage event during the count processing, pauses the count processing and opens the pay-in port opening-closing member, and
the controller alternately conveys the reject banknotes to the first pay-out port and the second pay-out port during the count processing.

2. The banknote processing device of claim 1, wherein the controller switches the conveyance destination of the reject banknotes between the first pay-out port and the second pay-out port each time a reject occurrence is detected.

3. A banknote processing device, comprising:
a pay-in port configured to receive banknotes;
a conveyance section configured to convey the banknotes received through the pay-in port;
a pay-in port opening-closing member configured to move to open and close the pay-in port;
a controller configured
to control the banknote conveyance of the conveyance section and the opening and closing operation of the pay-in port opening-closing member, and
to control count processing via which the received banknotes are counted;
a banknote classification section that classifies the banknotes during the count processing; and
a temporary stacking section in which banknotes conveyed from the pay-in port are temporarily stacked, wherein
the controller, upon detecting a count processing stoppage event during the count processing, pauses the count processing and opens the pay-in port opening-closing member, and
the stoppage event includes at least one of
a first event in which the controller receives a count processing stoppage request,
a second event in which all banknotes have been conveyed from the pay-in port,
a third event in which reject banknotes classified by the banknote classification section cannot be conveyed, and
a fourth event in which a specific number of reject banknotes are stacked in the temporary stacking section.

4. A banknote processing device comprising:
a pay-in port configured to receive banknotes;
a conveyance section configured to convey the banknotes received through the pay-in port;
a storage section to which the received banknotes are conveyed and stored;
a pay-in port opening-closing member configured to move to open and close the pay-in port;
a locking mechanism configured to lock the pay-in port opening-closing member; and
a controller configured
to control the banknote conveyance by the conveyance section, the opening and closing operation of the pay-in port opening-closing member, and operation of the locking mechanism, and
to control count processing via which the received banknotes are counted
wherein the controller, during conveyance of the received banknotes from the pay-in port to the storage section, releases a locked state of the pay-in port opening-closing member that is in a closed state.

5. The banknote processing device of claim 4, further comprising:
a temporary stacking section in which banknotes conveyed from the pay-in port during pay-in processing are temporarily stacked, wherein the controller, during conveyance of banknotes stacked in the temporary stacking section to the storage section, releases a locked state of the pay-in port opening-closing member that is in a closed state.

6. A banknote processing device, comprising:
a pay-in port configured to receive banknotes;
a conveyance section configured to convey the banknotes received through the pay-in port;
a pay-out port to which banknotes rejected during count processing are conveyed;
a pay-out port opening-closing member configured to move to open and close the pay-out port; and
a controller configured
to control the banknote conveyance of the conveyance section and the opening and closing operation of the pay-out port opening-closing member, and
to control the count processing via which the received banknotes are counted, wherein
the controller, upon detecting a count processing stoppage event during the count processing, pauses the count processing and opens the pay-out port opening-closing member, and
the count processing stoppage event includes an event indicating that all banknotes have been conveyed from the pay-in port.

7. The banknote processing device of claim 6, further comprising:
a banknote classification section configured to classify the banknotes during the count processing, wherein
a rejected banknote classified by the banknote classification section is conveyed to the pay-out port, and
the count processing stoppage event further includes an event indicating that the rejected banknote is conveyed to the pay-out port.

8. The banknote processing device of claim 7, further comprising:
a press plate provided in the pay-in port for pressing the banknote, the press plate being moved upon the detection of the count processing stoppage event by the controller.

* * * * *